US012275608B2

(12) United States Patent
Bertram et al.

(10) Patent No.: US 12,275,608 B2
(45) **Date of Patent: *Apr. 15, 2025**

(54) SPINDLE MECHANISM FOR PROTECTIVE PACKAGING DEVICE

(71) Applicant: Pregis Intellipack LLC, Chicago, IL (US)

(72) Inventors: George Bertram, Southbury, CT (US); Douglas Walker, Hamden, CT (US)

(73) Assignee: Pregis LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/453,145

(22) Filed: Aug. 21, 2023

(65) Prior Publication Data

US 2023/0391573 A1 Dec. 7, 2023

Related U.S. Application Data

(63) Continuation of application No. 16/391,026, filed on Apr. 22, 2019, now Pat. No. 11,731,849, which is a (Continued)

(51) Int. Cl.

| | |
|---|---|
| ***B65H 23/182*** | (2006.01) |
| ***B65H 19/12*** | (2006.01) |
| ***B65H 75/18*** | (2006.01) |
| ***B65H 75/30*** | (2006.01) |
| *B65H 16/10* | (2006.01) |

(Continued)

(52) U.S. Cl.

CPC ..... *B65H 23/182* (2013.01); *B65H 19/126* (2013.01); *B65H 75/185* (2013.01); *B65H 75/30* (2013.01); *B65H 16/103* (2013.01); *B65H 19/123* (2013.01); *B65H 23/063* (2013.01); *B65H 23/066* (2013.01); *B65H 23/185* (2013.01); *B65H 2402/51* (2013.01); *B65H 2701/11234* (2013.01);

(Continued)

(58) Field of Classification Search

CPC .. B65H 16/103; B65H 19/123; B65H 19/126; B65H 23/063; B65H 23/066; B65H 23/182; B65H 23/185; B65H 75/185; B65H 75/30; B65H 2402/51; B65H 2701/11234; B65H 2801/63; Y10T 156/10; Y10T 156/17

See application file for complete search history.

(56) References Cited

U.S. PATENT DOCUMENTS

| | | | |
|---|---|---|---|
| 2,561,155 A | 7/1951 | Thomas | |
| 2,961,179 A | 11/1960 | McNutt | |

(Continued)

FOREIGN PATENT DOCUMENTS

| | | | | |
|---|---|---|---|---|
| GB | 895731 A * | 8/1960 | ..... | F16D 3/185 |
| GB | 2264548 A * | 9/1993 | ..... | F16D 3/185 |

(Continued)

*Primary Examiner* — Robert F Long
*Assistant Examiner* — Eduardo R Ferrero
(74) *Attorney, Agent, or Firm* — Fox Rothschild LLP

(57) ABSTRACT

Disclosed is a web handling system that includes a spindle having a spindle magnetic coupling portion and a roll core configured for receiving the spindle for mounting thereon and having a roll magnetic coupling portion, wherein the spindle and roll magnetic coupling portions are configured for magnetically attracting each other to hold the roll on the spindle.

11 Claims, 27 Drawing Sheets

Related U.S. Application Data continuation of application No. 13/223,123, filed on Aug. 31, 2011, now Pat. No. 10,266,361.

(51) Int. Cl.
*B65H 23/06* (2006.01)
*B65H 23/185* (2006.01)

(52) U.S. Cl.
CPC ..... *B65H 2801/63* (2013.01); *Y10T 156/10* (2015.01); *Y10T 156/17* (2015.01)

(56) References Cited

U.S. PATENT DOCUMENTS 3,051,988 A 9/1962 Max
3,388,418 A 6/1968 Bey
3,396,919 A 8/1968 Vayda
3,510,079 A 5/1970 Flowers
3,525,478 A 8/1970 Whitehead et al.
3,552,693 A 1/1971 Scherf
3,556,430 A * 1/1971 Eisenhammer ..... B65H 67/02 211/1
3,577,723 A 5/1971 Page
3,691,130 A 9/1972 Logvinenko
3,695,531 A 10/1972 Whitehead
3,716,202 A 2/1973 Thomas
3,731,479 A 5/1973 Flowers et al.
3,805,507 A 4/1974 Steppuhn
3,833,332 A 9/1974 Amberg et al.
3,867,299 A 2/1975 Rohatgi
3,946,961 A 3/1976 Bahnsen
4,003,525 A 1/1977 Podvin et al.
4,008,860 A 2/1977 Tanaka
4,074,873 A 2/1978 Hayashi et al.
4,074,875 A 2/1978 Fratturo
4,122,563 A 10/1978 Johnson
4,161,298 A 7/1979 Davis
4,179,077 A 12/1979 Morishita
4,381,083 A 4/1983 Tsunetsugu
4,387,556 A 6/1983 Studtmann et al.
4,432,504 A 2/1984 Pace
H43 H 4/1986 Michaels
4,609,164 A 9/1986 Komatsubara et al.
4,754,181 A 6/1988 Mizobuchi et al.
4,824,038 A 4/1989 Chandler
4,854,109 A 8/1989 Pinarer et al.
4,907,460 A 3/1990 Taniguchi et al.
4,915,319 A 4/1990 Gerber
4,938,007 A 7/1990 Sperry
5,125,255 A 6/1992 Brown et al.
5,139,151 A 8/1992 Chelak
5,186,905 A 2/1993 Bertram et al.
5,263,854 A 11/1993 Bradshaw
5,375,723 A 12/1994 Kelley
5,376,219 A 12/1994 Sperry et al.
5,400,960 A 3/1995 Jeffs
5,503,349 A 4/1996 Chertok
5,524,805 A 6/1996 Shiba et al.
5,575,435 A 11/1996 Sperry et al.
5,679,208 A 10/1997 Sperry et al.
5,699,902 A 12/1997 Sperry et al.
5,709,347 A 1/1998 Hoffmann et al.
5,713,405 A 2/1998 Kashiwagi
5,720,102 A 2/1998 McClanahan
5,727,370 A 3/1998 Sperry
5,791,442 A 8/1998 Arnold
5,791,522 A 8/1998 Lee et al.
5,950,875 A 9/1999 Lee et al.
5,967,445 A 10/1999 Yuyama et al.
6,035,518 A 3/2000 Slivar
6,131,375 A 10/2000 Sperry
6,145,771 A 11/2000 Santa Cruz et al.
6,194,798 B1 2/2001 Lopatinsky
6,234,228 B1 5/2001 Atkinson et al.
6,257,512 B1 7/2001 Schoeck et al.
6,279,849 B1 8/2001 Martin
6,283,174 B1 9/2001 Sperry et al.
6,286,780 B1 9/2001 Yuyama et al.
6,289,649 B1 9/2001 Cherfane
6,315,227 B1 11/2001 Schoeck
6,425,236 B1 7/2002 Roquet et al.
6,533,214 B1 3/2003 Guttin
6,585,181 B2 7/2003 Kronenberger
6,596,371 B1 7/2003 Billarant et al.
6,675,557 B2 1/2004 Sperry et al.
6,710,491 B2 3/2004 Wu et al.
6,811,059 B2 11/2004 Piucci, Jr. et al.
6,820,835 B2 11/2004 Cavaliere et al.
6,877,543 B2 4/2005 Stevens
6,996,956 B2 2/2006 Sperry et al.
7,124,976 B1 10/2006 DeVincenzo
7,160,096 B2 1/2007 Knaak et al.
7,328,541 B2 2/2008 Garceau et al.
7,331,542 B2 2/2008 Cocciadiferro et al.
7,367,171 B2 5/2008 Bertram et al.
7,429,304 B2 9/2008 McNamara, Jr. et al.
7,603,831 B2 10/2009 Sperry et al.
7,735,685 B2 6/2010 Bertram
2003/0122024 A1 7/2003 Slezak
2003/0146338 A1 8/2003 Hogberg et al.
2003/0234474 A1 12/2003 Williams
2004/0056140 A1 3/2004 Brandli et al.
2004/0118964 A1 6/2004 Long
2005/0029391 A1 2/2005 Cocciadiferro et al.
2005/0056655 A1 3/2005 Gary
2006/0165323 A1 7/2006 Son et al.
2008/0129462 A1 6/2008 Vignola et al.
2008/0149449 A1 6/2008 Hill
2009/0056286 A1 3/2009 Bertram et al.
2010/0043380 A1 2/2010 Artzt et al.
2010/0113242 A1 5/2010 Gelli et al.
2012/0145819 A1 6/2012 Matthies et al.
2012/0211585 A1 8/2012 Kim
2013/0047554 A1 2/2013 Bertram et al.

FOREIGN PATENT DOCUMENTS

JP 508250 1/1975
JP 60149108 8/1985
JP 61045849 3/1986
JP 2004090995 A 3/2004
JP 2011111195 A 6/2011
JP 4731804 B2 7/2011
JP 5310827 B2 10/2013
WO 03006355 A1 1/2003

* cited by examiner

SPINDLE MECHANISM FOR PROTECTIVE PACKAGING DEVICE

CROSS-REFERENCE TO RELATED APPLICATIONS

The present application is a continuation of U.S. patent application Ser. No. 16/391,026, filed Apr. 22, 2019, which is a continuation of U.S. patent application Ser. No. 13/223,123, filed Aug. 31, 2011, which are incorporated herein by reference in their entirety.

TECHNICAL FIELD

The present disclosure is directed to a dispensing system and components therefore. In particular, the present disclosure is directed to a foam-in-bag dispensing apparatus used to produce foam-filled bags, and components having application in the foam-in-bag apparatus.

BACKGROUND

Foam material dispensers have been developed including those directed at dispensing polyurethane foam precursor that are mixed together to form a polymeric product. The chemicals are often selected so that they harden following a generation of carbon dioxide and water vapor, and they have been used to form "hardened" (e.g., a cushioning quality in a proper fully expanded state) polymer foams in which the mechanical foaming action is caused by the gaseous carbon dioxide and water vapor leaving the mixture.

In particular techniques, synthetic foams such as polyurethane foam are formed from liquid organic resins and polyisocyanates in a mixing chamber (e.g., a liquid form of isocyanate, which is often referenced in the industry as chemical "A", and a multi-component liquid blend called polyurethane resin, which is often referenced in the industry as chemical "B"). The mixture can be dispensed into a receptacle, such as a package or a foam-in-place bag, where it reacts to form a polyurethane foam.

Example foam-in-bag devices known in the art include a film spindle, wherein a roll of film for bag making is mounted onto a spindle attached to the device. The roll feeds the device with film as it unwinds during operation. In order to load and unload the spindle with a roll of film, it is known in the art to use a latch positioned along the support column of the device, which operatively latches to a hinge. When not latched, the hinge allows the spindle to swing outwardly from the device for loading and unloading. Moving the spindle back into the operating position causes the latch to connect with the hinge, and hold the spindle in place during operation.

BRIEF SUMMARY OF THE DISCLOSURE

In one aspect of the disclosed technology, a protective packaging device includes a filling mechanism configured for filling a space between plies of a web with a substance; a sealing mechanism configured for sealing the filled plies to retain the substance therebetween; and a supply unit.

The supply unit includes a roll core and the web provided as a roll thereon. The roll core includes a roll core mechanical coupling portion including a plurality of roll core engagement features spaced around an inner diameter thereof; and a roll core magnetic coupling portion; and The supply unit also includes a web handling system having a base portion; and a spindle extending from the base portion and configured for receiving the roll core thereon. The spindle is further configured to rotate about a horizontally-oriented axis extending in an axial direction of the spindle. The spindle includes a first end portion adjacent the base portion; a freestanding second end portion; and a spindle mechanical coupling portion located at the first end portion of the spindle and including a plurality of spindle engagement features spaced around the spindle mechanical coupling portion and extending in the axial direction of the spindle between a first and a second axial position.

The spindle engagement features of the spindle mechanical coupling portion and the roll core engagement features of the roll core mechanical coupling portion mate with each other to transmit torque between the spindle and the roll core.

The web handling system also includes a spindle magnetic coupling portion located at the first end portion of the spindle and on the spindle mechanical coupling portion. The spindle magnetic coupling portion includes at least one magnet positioned, at least in part, at the first axial position and radially outward of the teeth or splines. The spindle magnetic coupling portion is configured to magnetically attract the roll core magnetic coupling portion in a horizontal direction to maintain the mating of the spindle engagement features of the spindle mechanical coupling portion and the roll core engagement features of the roll core mechanical coupling portion when the roll core is received on the spindle.

In another aspect of the disclosed technology, the substance includes a foam precursor that is adapted to solidify into protective foam packaging.

In another aspect of the disclosed technology, the spindle mechanical coupling portion is configured for insertion into the roll core mechanical coupling portion to engage the spindle mechanical coupling portion and the roll core mechanical coupling portion.

In another aspect of the disclosed technology, the roll core magnetic coupling portion includes a material that is magnetically attracted to magnets.

In another aspect of the disclosed technology, the roll core magnetic coupling portion includes a ferrous material impregnated in a plastic matrix.

In another aspect of the disclosed technology, the roll core mechanical coupling portion includes the ferrous material impregnated in the plastic matrix, such that the roll core mechanical coupling portion and the roll core magnetic coupling portion include a same portion of the roll core.

In another aspect of the disclosed technology, the at least one magnet includes a neodymium-iron boron magnet.

In another aspect of the disclosed technology, the at least one magnet includes a permanent magnet.

In another aspect of the disclosed technology, the at least one magnet includes an electronic magnet.

In another aspect of the disclosed technology, the electronic magnet includes an inductor.

In another aspect of the disclosed technology, a protective packaging device includes a filling mechanism configured for filling a space between plies of a web with a substance; a sealing mechanism configured for sealing the filled plies to retain the substance therebetween; and a supply unit.

The supply unit includes a roll core and the web provided as a roll thereon, which roll core includes a roll core mechanical coupling portion including a plurality of roll core engagement features spaced around an inner diameter thereof and extending in the axial direction of the roll core between a first and a second axial position; and The roll core also includes a roll core magnetic coupling portion having least one magnet positioned, at least in part, at the first axial position and radially outward of the roll core mechanical coupling portion.

The supply unit also includes a web handling system having a base portion; and a spindle extending from the base portion and configured for receiving the roll core thereon. The spindle is further configured to rotate about a horizontally-oriented axis extending in an axial direction of the spindle.

The spindle includes a first end portion adjacent the base portion; a freestanding second end portion; and a spindle mechanical coupling portion located at the first end portion of the spindle and including a plurality of spindle engagement features spaced around the spindle mechanical coupling portion. The spindle engagement features of the spindle mechanical coupling portion and the roll core engagement features of the roll core mechanical coupling portion mate with each other to transmit torque between the spindle and the roll core.

The spindle also includes a spindle magnetic coupling portion located at the first end portion of the spindle and on the spindle mechanical coupling portion. The roll core magnetic coupling portion is configured to magnetically attract the spindle magnetic coupling portion in a horizontal direction to maintain the mating of the spindle engagement features of the spindle mechanical coupling portion and the roll core engagement features of the roll core mechanical coupling portion when the roll core is received on the spindle.

In another aspect of the disclosed technology, the substance includes a foam precursor that is adapted to solidify into protective foam packaging.

In another aspect of the disclosed technology, the spindle mechanical coupling portion is configured for insertion into the roll core mechanical coupling portion to engage the spindle mechanical coupling portion and the roll core mechanical coupling portion.

In another aspect of the disclosed technology, the spindle magnetic coupling portion includes a material that is magnetically attracted to magnets.

In another aspect of the disclosed technology, the spindle magnetic coupling portion includes a ferrous material impregnated in a plastic matrix.

In another aspect of the disclosed technology, the spindle mechanical coupling portion includes the ferrous material impregnated in the plastic matrix, such that the spindle mechanical coupling portion and spindle magnetic coupling portion include a same portion of the spindle.

In another aspect of the disclosed technology, the at least one magnet includes a neodymium-iron boron magnet.

In another aspect of the disclosed technology, he at least one magnet includes a permanent magnet.

In another aspect of the disclosed technology, the at least one magnet includes an electronic magnet.

In another aspect of the disclosed technology, the electronic magnet includes an inductor.

While multiple embodiments are disclosed, still other embodiments in accordance with the present disclosure will become apparent to those skilled in the art from the following detailed description, which shows and describes illustrative embodiments. As will be realized, the disclosed embodiments are capable of modifications in various aspects, all without departing from the spirit and scope of thereof. Accordingly, the drawings and detailed description are to be regarded as illustrative in nature and not restrictive.

BRIEF DESCRIPTION OF THE FIGURES

While the specification concludes with claims particularly pointing out and distinctly claiming the subject matter that is regarded as forming the various embodiments of the present disclosure, it is believed that the embodiments will be better understood from the accompanying figures, in which:

DETAILED DESCRIPTION

With general reference to FIGS. 1-4, the present disclosure is directed to a dispensing system and components therefore. In particular, the present disclosure a foam-in-bag dispensing apparatus 20 used to produce foam-filled bags, and components having application in the foam-in-bag apparatus. Specific aspects of the apparatus 20 are discussed as follows.

Figure 1:
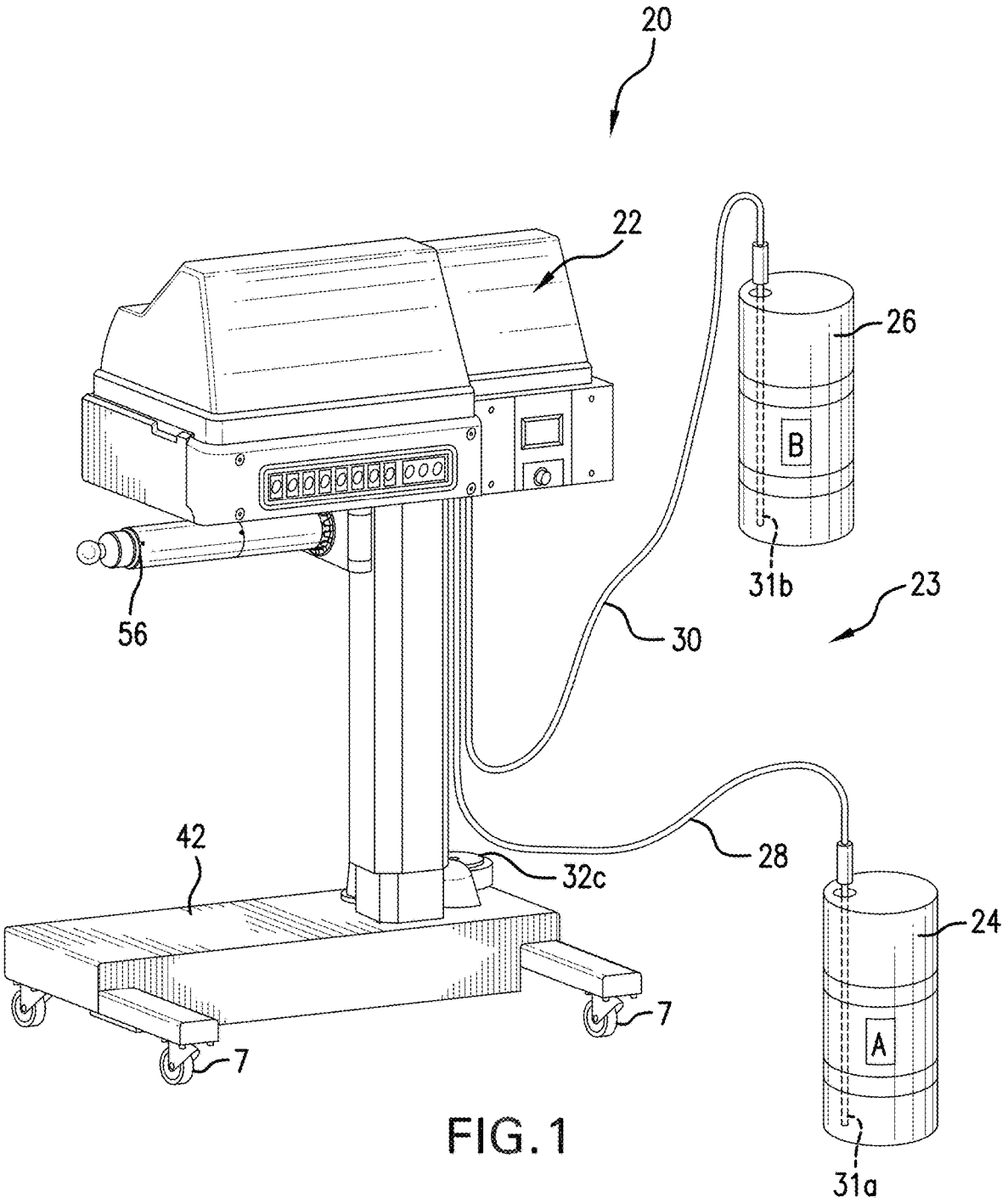
FIG. 1 illustrates an embodiment of the dispensing system of the present disclosure.

FIG. 1 illustrates a preferred embodiment of the dispensing system 20 of the present disclosure, which includes dispenser system 22 in communication with the chemical supply system 23, itself including chemical supply container 24 (supplying chemical component A) and chemical supply container 26 (supplying chemical component B). Chemical hoses 28 (chemical A) and 30 (chemical B), in connection with tubes 31*a*, 31*b* (extending into the containers 24,26), provide fluid communication between respective chemical supply containers 24, 26 and in-line pumps 32*a*, 32*b* mounted on dispenser system 22 (see FIG. 11). Dispenser system 22 can include in-line pumps 32*a*, 32*b* that is in communication with chemical supply containers that are either in proximity (for example, 40 feet or less) to the dispenser system 22 or remote (for example, greater than 40 feet) from where the dispenser system 22 is located. This allows the containers to be situated in a more convenient or less busy area of a plant or other facility wherein the dispensing apparatus 20 is employed, as it is often not practical to store chemicals in close proximity to the dispenser system 22 (for example, 100 to 500 feet separation of dispenser system 22 and chemicals 24, 26 may be desirable in some applications). Thus, it is inherent in the present disclosure that a great deal of versatility as to how the dispenser system is to be set up relative to the chemical source is possible. As a number of installations require that the containers be stored hundreds of feet (for example, 100 to 500 feet or more) away from the system. In another embodiment, where the distance between the containers 24, 26 is shorter, e.g., about 20 feet to about 40 feet, tubes 31*a*, 31*b* may be replaced by pumps in containers 24, 26. The pumps 32*a*, 32*b* feed chemicals A and B to the system 22 via hoses 28, 30. It will be appreciated that in any embodiment, the chemicals A and B may be fed to the system 22 at its base, at the head, or at any other position of the system 22. The present disclosure is designed to accommodate these long, or short, length installation requirements, as may be present in any particular application.

Figure 3:
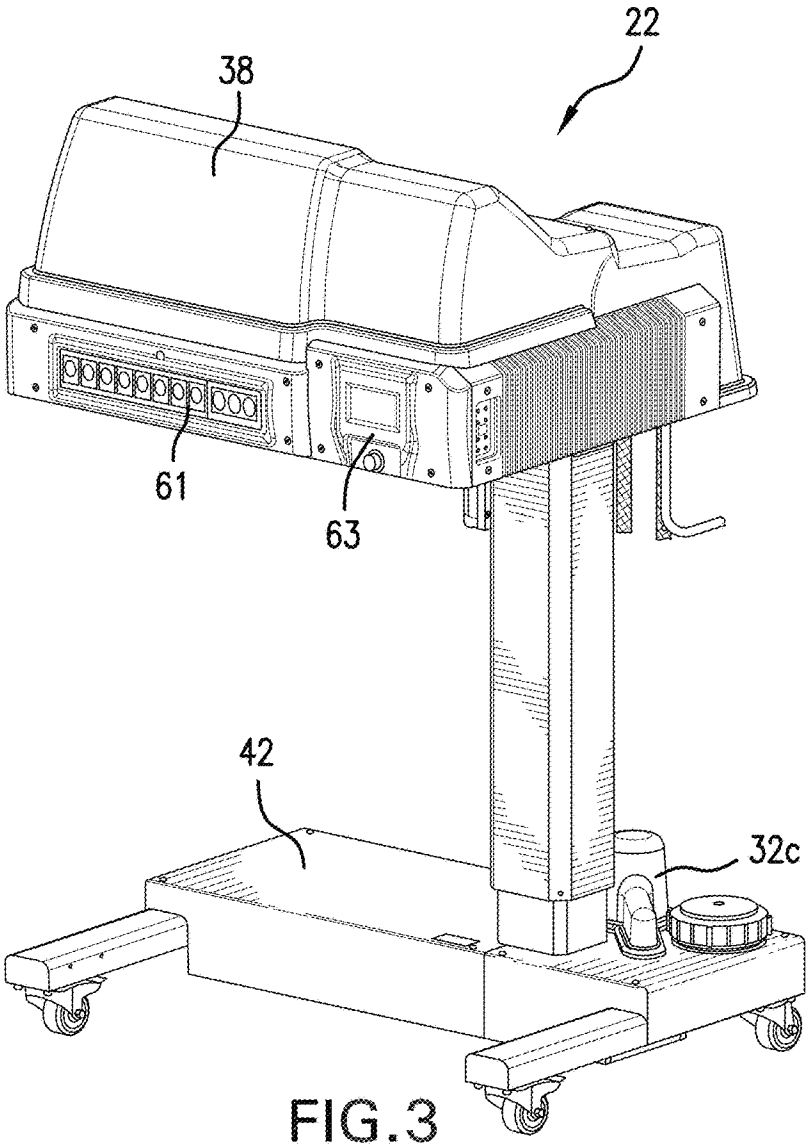
FIGS. 2 and 3 illustrate a rear and front view, respectively of a dispenser system of the dispensing system as in FIG. 1.
Figure 2:
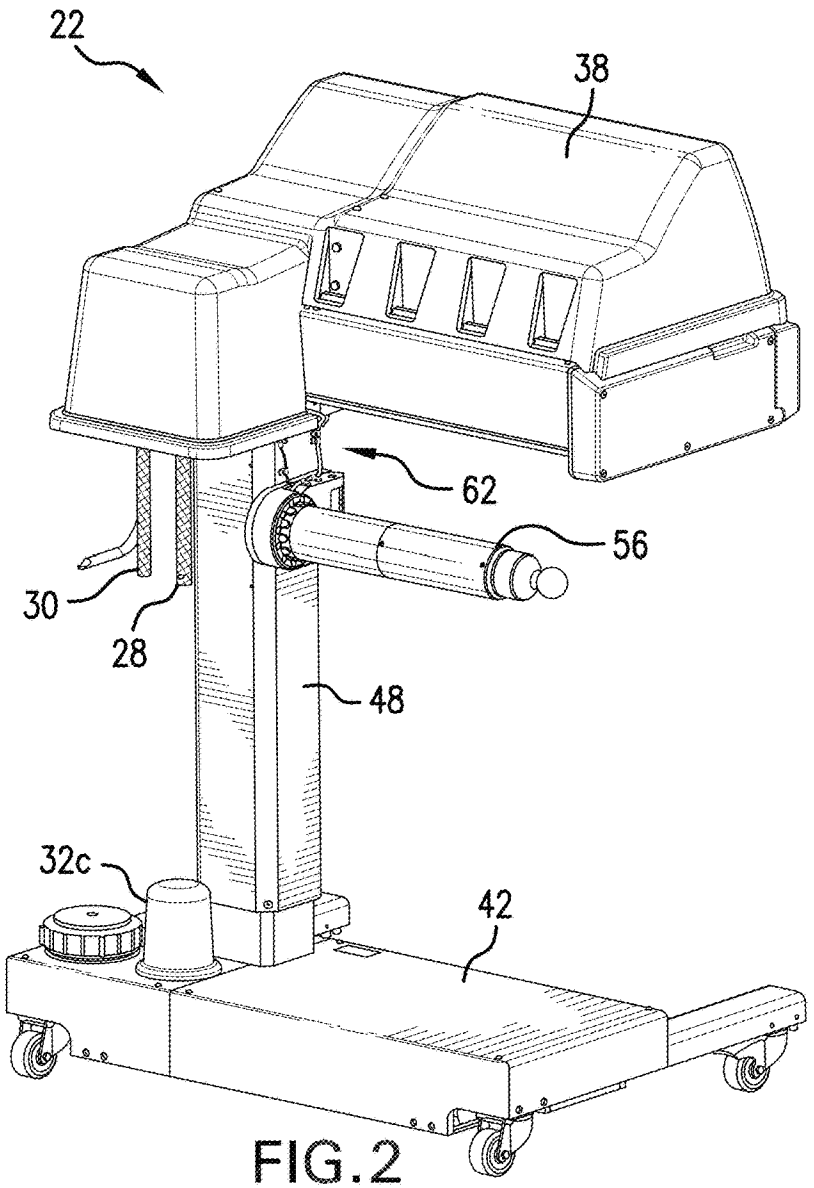

FIGS. 2 and 3 provide rear and front elevational views, respectively, of dispenser system 22 which includes exterior housing 38 supported on telescoping support assembly 40, which in a preferred embodiment includes a lifter (for example, an electric motor driven gear and rack system with inner and outer telescoping sleeves or a screw mechanism) and is mounted on base 42 (for example, a roller platform base to provide some degree of mobility). Further mounted on base 42 is solvent pump system 32*c* (shown covered) configured to deliver a solvent cleaning solution from a solvent tank, through the assembly 40, and into the chemical dispenser apparatus (discussed in greater detail below) where such solvent is used to clean the tip of the mixing module (also discussed in greater detail below). Film roll reception assembly 56 preferably extends out from support assembly 48. FIG. 3 further provides a view of first and second control panels 61, 63.

Figure 4:
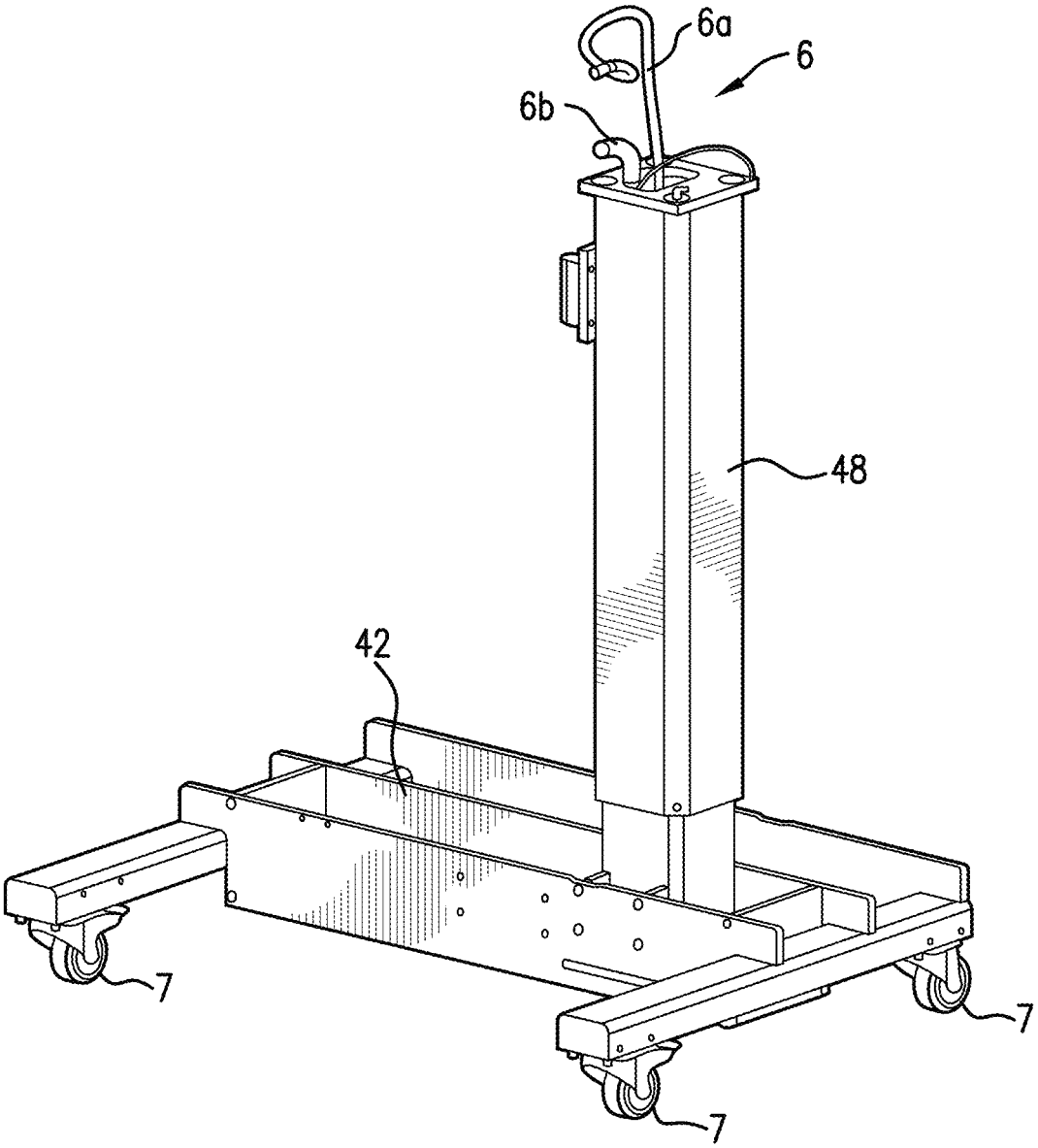
FIG. 4 illustrates a base and extendable support assembly of the dispenser system.

FIG. 4 illustrates base 42 and lifter or extendable support assembly 48 (e.g., preferably a hydraulic (air pressure) or gear/rack combination or some other telescoping or slide lift arrangement or a screw mechanism) extending up from base 42. FIG. 4 also illustrates the mobile nature of base 42 which is a wheeled assembly (wheels 7). Further shown are the connection assembly 6, including a solvent line 6*a* and electrical connectors 6*b*.

FIGS. 5-8 generally show aspects of a foam-in-bag assembly or "bagger assembly" of the present embodiment. The assembly includes frame sections 71, 73 which form a unitary flip door frame, and may be made of extruded aluminum. A rod 70 is fixed to the flip door frame sections 71, 73 and pivots in a hole in plate 66. Driver roller shaft 72, supporting left and right driven or follower nip rollers 74, 76. While in a latched state, the upper ends of frame sections 71, 73 are also supported (locked in closed position) by door latch rod 85 with handle latch 87.

Drive shaft 82 supports drive nip rollers 84, 86. Driven roller shaft 72 and driver roller shaft 82 are in parallel relationship and spaced apart so as to place the driven nip rollers 74, 76, and drive nip rollers 84, 86 in a film drive relationship with a preferred embodiment featuring a motor driven drive roller set 84, 86, driven by motor 80*a*, formed of a compressible, high friction material such as an elastomeric material (for example, a synthetic rubber) and the opposite, driven roller 74, 76 is preferably formed of a knurled aluminum nip roller set (although alternate arrangement are also featured as in both sets being formed of a compressible material like rubber). In some embodiments, shaft 72 and rollers 74, 76 may be of unitary construction.

Figure 7:
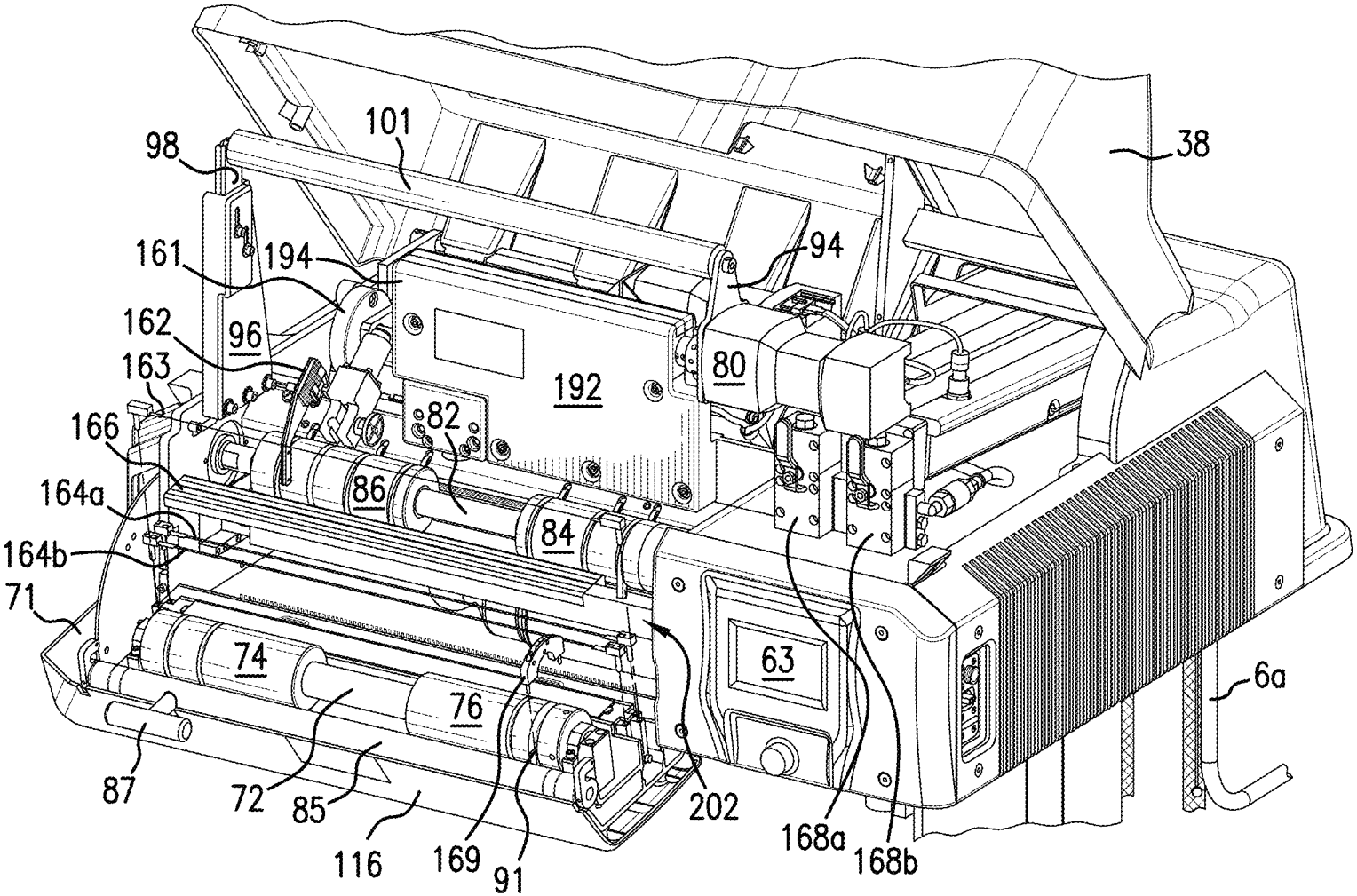

Drive nip rollers 84, 86 have slots formed for receiving film wrapping preventing means 90 (for example, canes 90). For example, canes 90 may be employed to prevent the film web from wrapping around the nip rollers 84, 86. FIG. 7 further illustrates bag film edge sealer 169 shown received within a slot 91 in roller 76 and positioned to provide edge sealing to a preferred C-fold film supply. Support portions 94 and 96 extend upward from the nip roller contact location. Support portion 94 supports the dispenser apparatus 92. Support portion 96 includes an upper portion 98 that includes a means for receiving an end of upper idler roller 101. The other end of the idler roller 101 is supported by support portion 100.

Idler roller 101 can preferably be adjusted to accommodate any roller assembly position deviation that can lead to non-proper tracking and also can be used to avoid wrinkled or non-smooth bag film contact. Also, idler roller 101 is preferably a steel or metal roller and not a plastic roller to avoid static charge build up relative to the preferred plastic film supplied. Idler roller is also preferably of the type having roller bearings positioned at its ends (not shown) for smooth performance and smooth, unwrinkled film feed.

Figure 5:
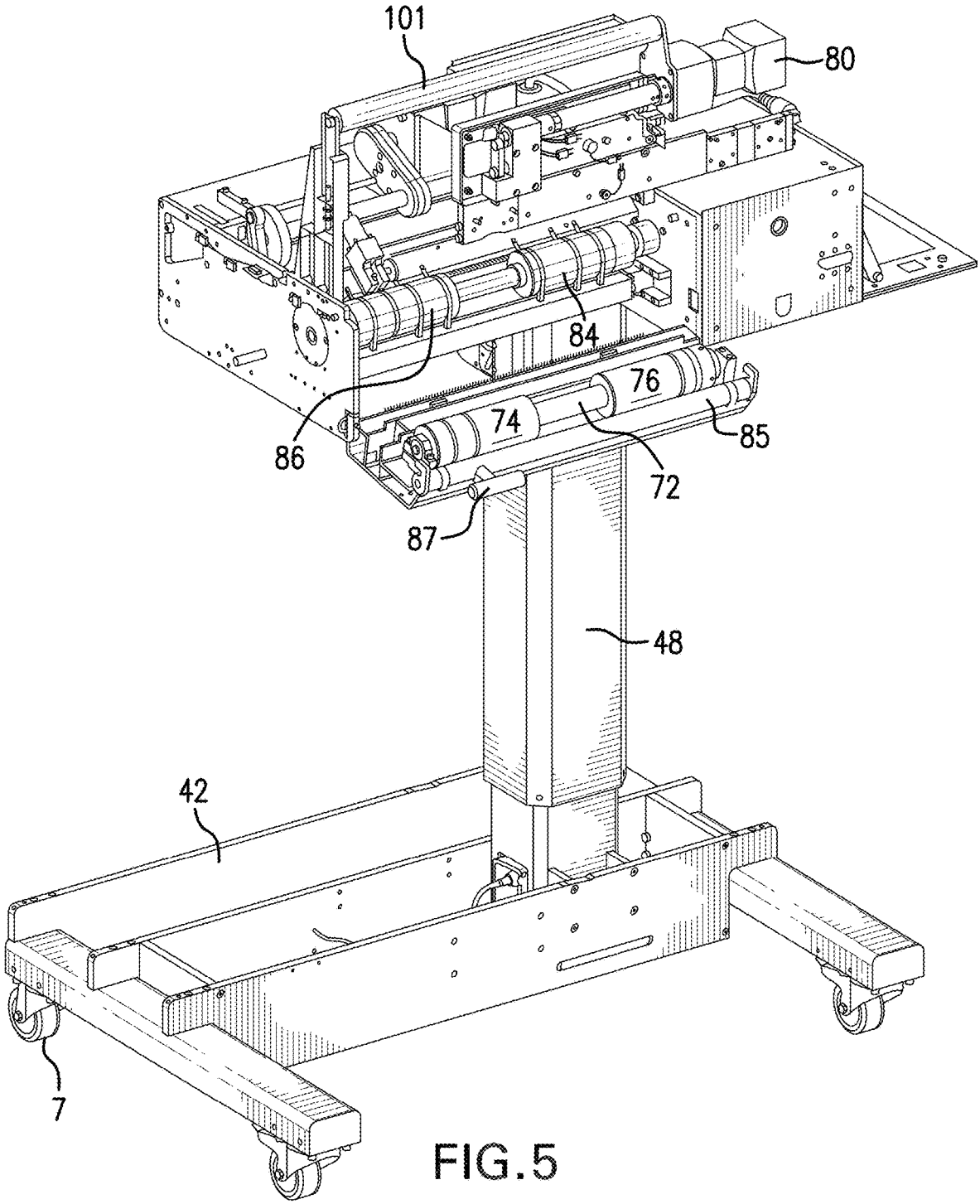
FIGS. 5-8 illustrate front perspective views of a bag forming assembly of the dispenser system of the present disclosure.
Figure 6:
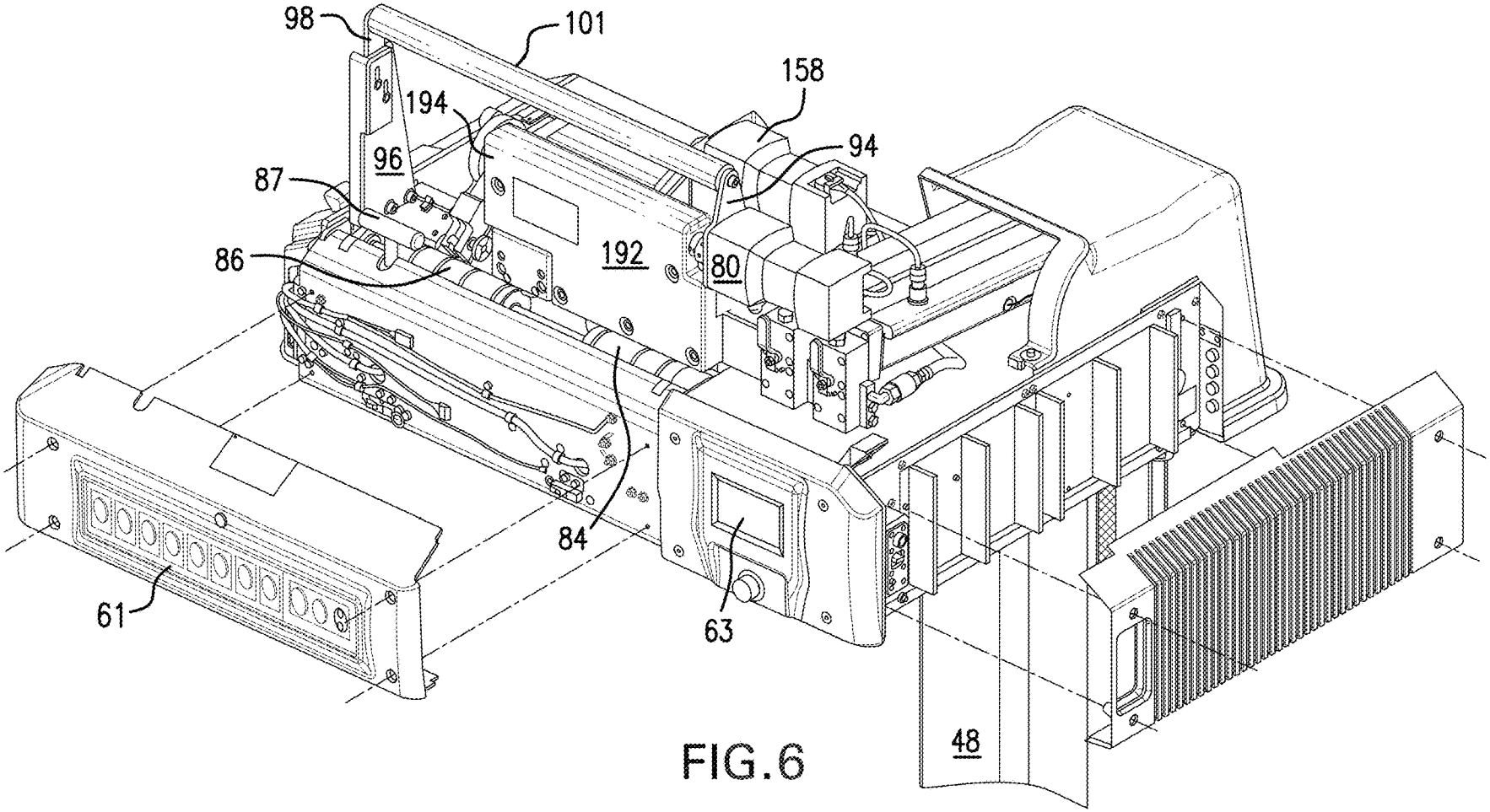

Also, FIGS. 5-8 show first (preferably being releasably lockable in an operative position) end or cross-cut/seal support block or cut/seal jaw 116 positioned forward of a vertical plane passing through the nip roller contact location and below the axis of rotation of drive shaft 82. End cut/seal jaw 116, which preferably is operationally fixed in position, in this embodiment has extruded aluminum construction (and is part of the flip door frame) of a sufficiently high strength so that it is not easily deformed over an extended length, and that is of sufficient heat resistance to withstand heat from the heated sealing and cutting elements (for example, a steel block with a zinc and/or chrome exterior plating), and preferably extends between left and right frame structures 66, and 68, but again, like driven shaft 72 and rollers 74, 76. The cut/seal jaw 116 is preferably supported on pivot frame sections 71, 73 and extends parallel with driven shaft 72. In some embodiments, the cut/seal jaw 116 may be of unitary construction with the sections 71, 73. FIG. 5 illustrates block 116 rigidly fixed at its ends to the opposing, interior sides of pivot frame sections 71, and 73 for movement therewith when latch (handle 87 of the latch is shown) is released. The sealing jaw 116 includes an actuator 161. Cut seal jaw operates with complementary jaw 116*b*, driven by motor 158 along track 117, to hold the film web in place during operation. In one embodiment, a crank is employed to drive the jaw 116*b*. In other embodiments, a solenoid or other means may be employed. Further disclosed is a vent cutter 162 for venting the bags, cutting wire 163 for cutting the bags, sealing wires 164*a* and 164*b*, and longitudinal sealing wires 169. The cutting and sealing wires are heated, with the heat transmitted by the cutting wire 163 to the film being greater than that of the sealing wires 163*a*, 163*b*. A PTFE (Teflon) film 166 can be used over the sealing wires 163*a* decrease the heat transmitted to the film compared to from the cutting wire 163.

Figure 8:
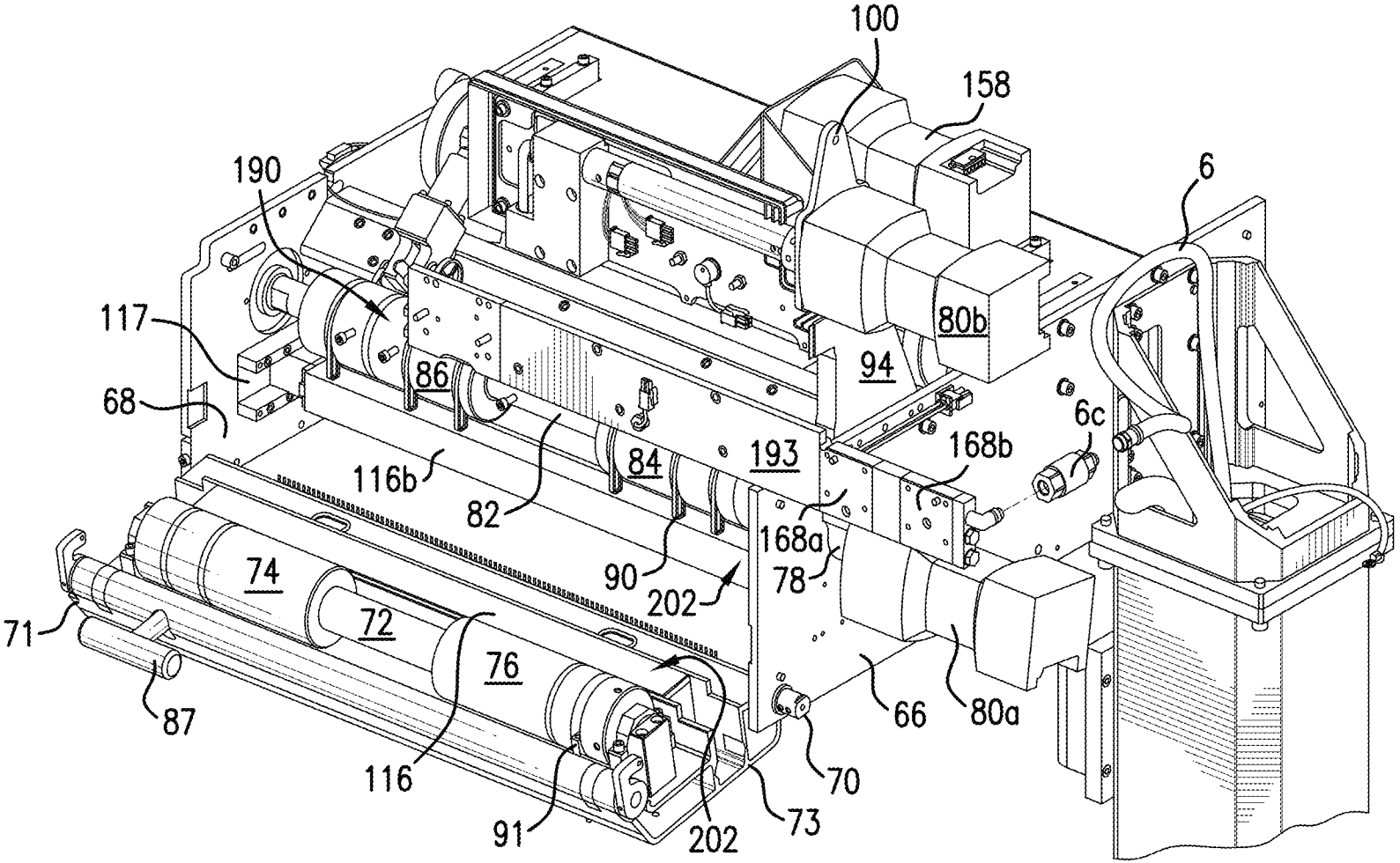
Figure 9:
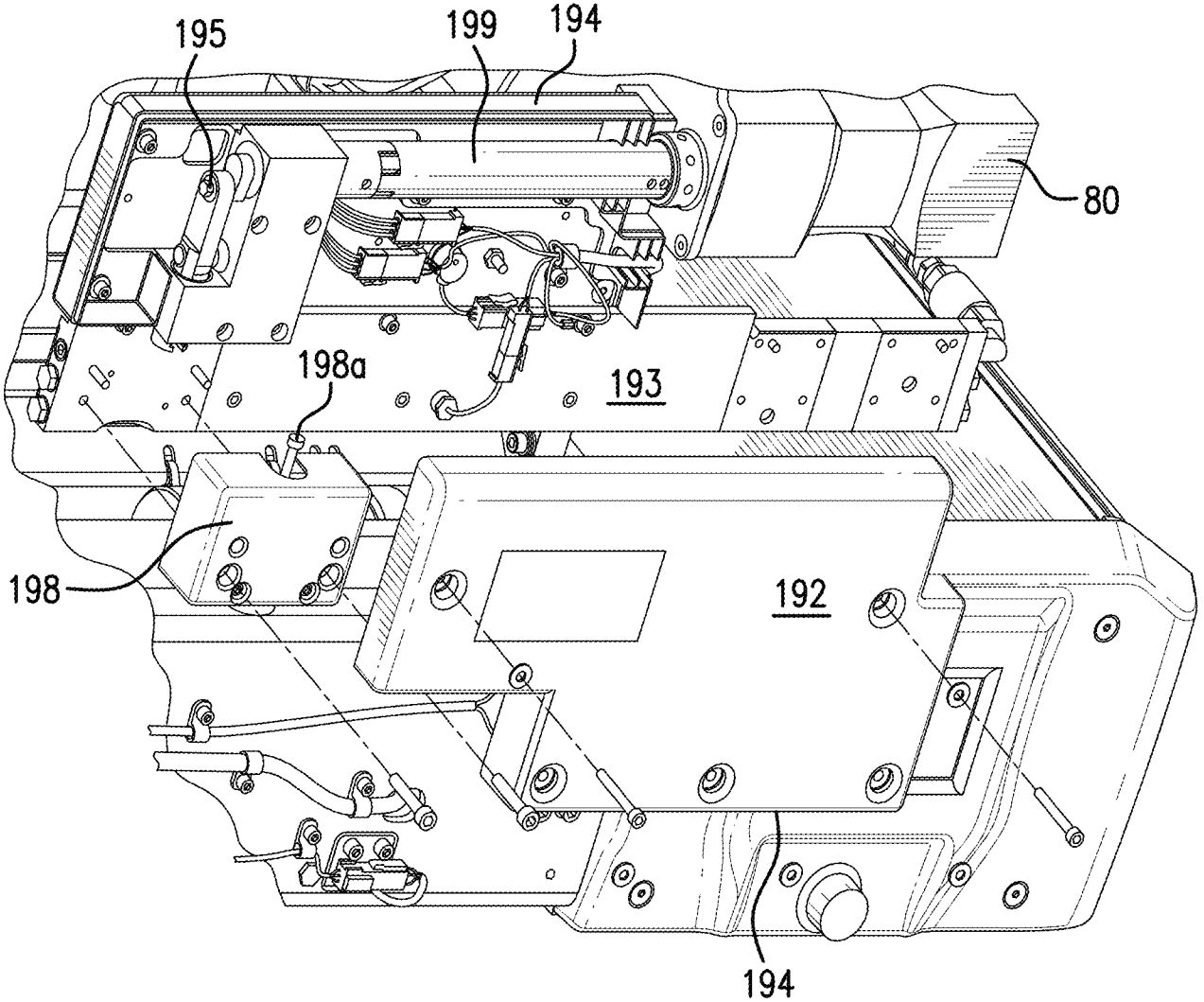
FIG. 9 illustrates a front perspective view of dispenser apparatus of the bag forming assembly.

Referring to FIG. 9, dispenser apparatus 192 includes a housing 194, motor 80*b*, and manifold 193. Dispenser apparatus 192 functions to dispense the foam precursor(s), such as chemicals A and B, between plies of a film web 216, and the plies are sealed together and cut to form a bag. In this manner, the dispenser apparatus 192 serves to form the foam-in-bag products as described herein. Shutoff valves 168*a*, 168*b*, for chemicals A and B, respectively, are shown in FIG. 7. A dispenser outlet preferably is also positioned above and centrally axially situated between first and second side frame structures 66, 68. With this positioning, dispensing of material (chemicals A and B) can be carried out in the clearance space defined axially between the two respective nip roller sets 74, 76 and 84, 86. Dispenser assembly 192 is preferably supported a short distance above (for example, a separation distance of about 1 to 5 inches and preferably about 2 to 3 inches) the nip contact location or the underlying (preferably horizontal) plane on which both rotation axes of shafts 72, 82 fall. This arrangement allows for receipt of chemical in the bag-being formed in direct fashion and with a lessening of spray or spillage due to a higher clearance relationship as in the prior art. Mixing module 198 mixes chemicals A and B prior to insertion into the web 216, and includes a valve stem 198*a* actuated by actuator 195, which itself is driven by shaft 199 and motor 80*b*. Solvent is delivered to the mixing module using solvent line 6*a* and manifold 6*c* (shown in FIG. 8). Manifold 6*c* is provided for a check valve that functions to produce sufficient back pressure in the solvent hose. The mixing module is secured by an attachment means 190 (shown in FIG. 8), which may include one or more screws and pins. The pins also serve to accurately position the mixing module 198 with respect to the actuator 195.

Figure 10:
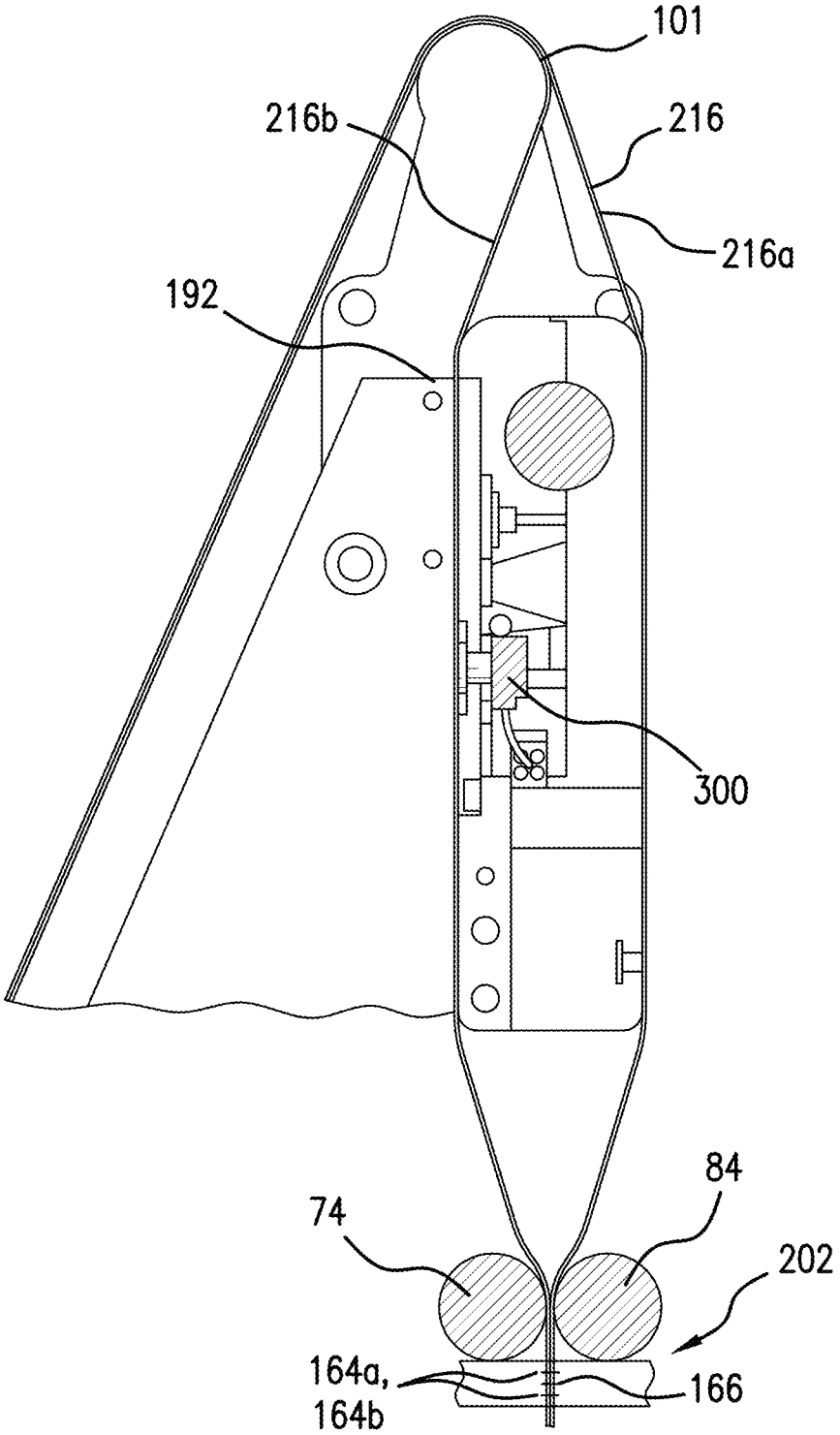
FIG. 10 illustrates a portion of a film travel path through the dispenser apparatus in accordance with the present disclosure.

FIGS. 8 and 10 provides a side elevational view of dispenser system 192 and jaw assembly 202, including jaws 116 and 116*b*, in relationship to film 216 which in a preferred embodiment is a C-fold film featuring a common fold edge and two free edges at the opposite end of the two fold panel. The jaw assembly is configured for driving 116*b* against 116 with sufficient force to pinch the two film plies to performs the sealing and cutting and to keep the precursors from leaking past the jaws before the sealing is complete. While a C-fold film is a preferred film choice, a variety of other film types of film or bag material sources are suitable for use of the present invention including gusseted and non-gusseted film, tubular film (preferably with an upstream slit formation means (not shown) for passage past the dispenser) or two separate or independent film sources (in which case an opposite film roll and film path is added together with an added side edge sealer) or a single film roll comprised of two layers with opposite free edges in a stacked and rolled relationship (also requiring a two side edge seal not needed with the preferred C-fold film usage wherein only the non-fold film edging needs to be edge sealed). For example, in a preferred embodiment, in addition to the single fold C-fold film, with planar front and back surfaces, a larger volume bag is provided with the same left to right edge film travel width (for example, 12 inch or 19 inch) and features a gusseted film such as one having a common fold edge and a V-fold provided at that fold end and on the other, interior side, free edges for both the front and rear film sheets sharing the common fold line. The interior edges each have a V-fold that is preferably less than a third of the overall width of the sheet.

As further shown in FIG. 10 after leaving the film roll and traveling past the lower idler roller, the film is wrapped around upper idler roller 101 and exits at a position where it is shown to have a vertical film departure tangent vertically aligned with the nip contact edge of the nip roller sets. Because of the C-fold arrangement, the folded edge is free to travel outward of the cantilever supported dispenser system 192. That is, depending upon film width desired, the folded end of C-fold film 216 travels vertically down to the left side of dispenser end section 196 for driving nip engagement with the contacting, left set of nip rollers. The opposite end of film 216 with free edges travels along the smooth surface of dispenser housing whereupon the free edges are brought together for driving engagement relative to contacting right nip roller set (76, 84) for the bag being formed.

Figure 11:
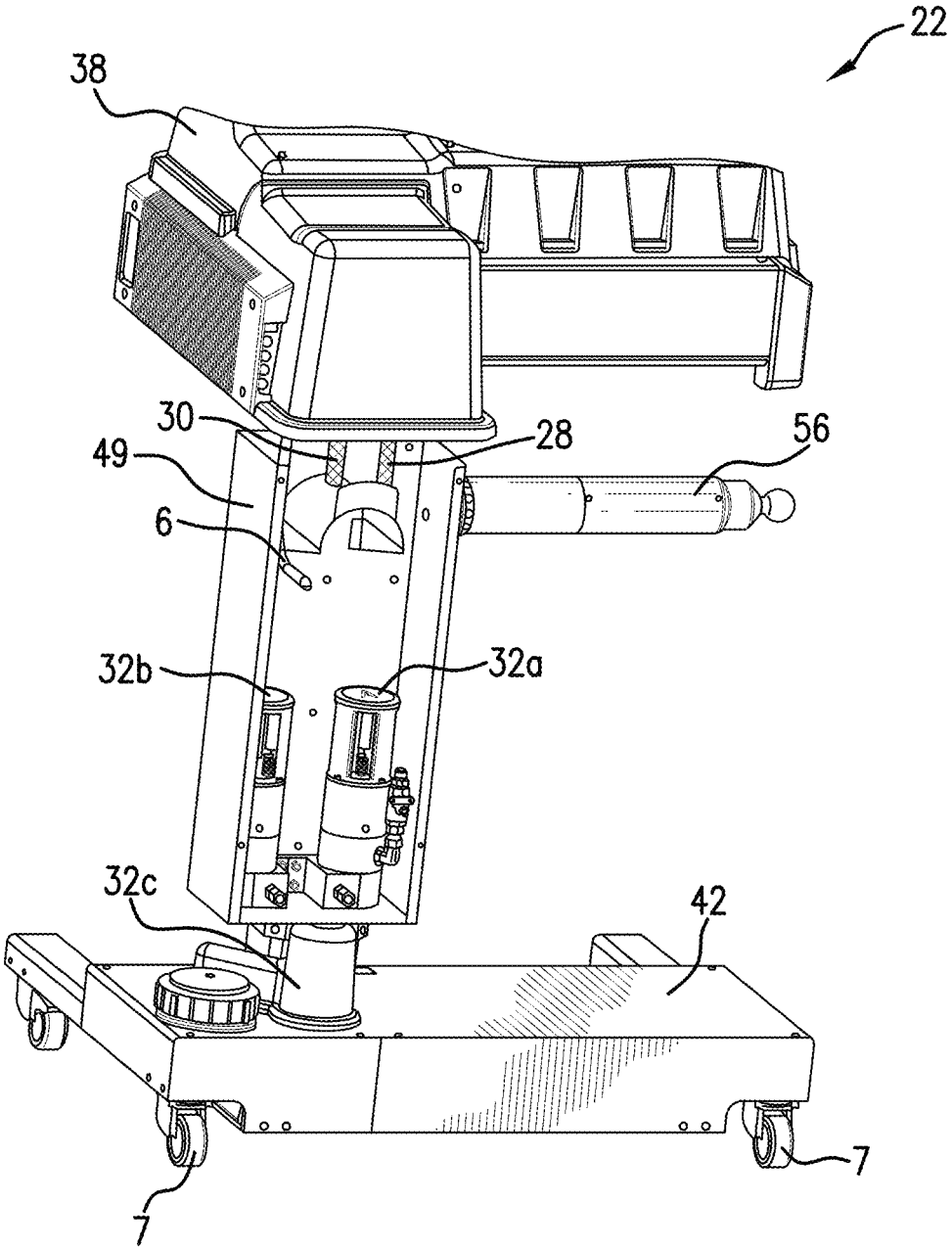
FIG. 11 illustrates a view of an inline pump assembly and hose manager in accordance with the present disclosure.
Figure 12:
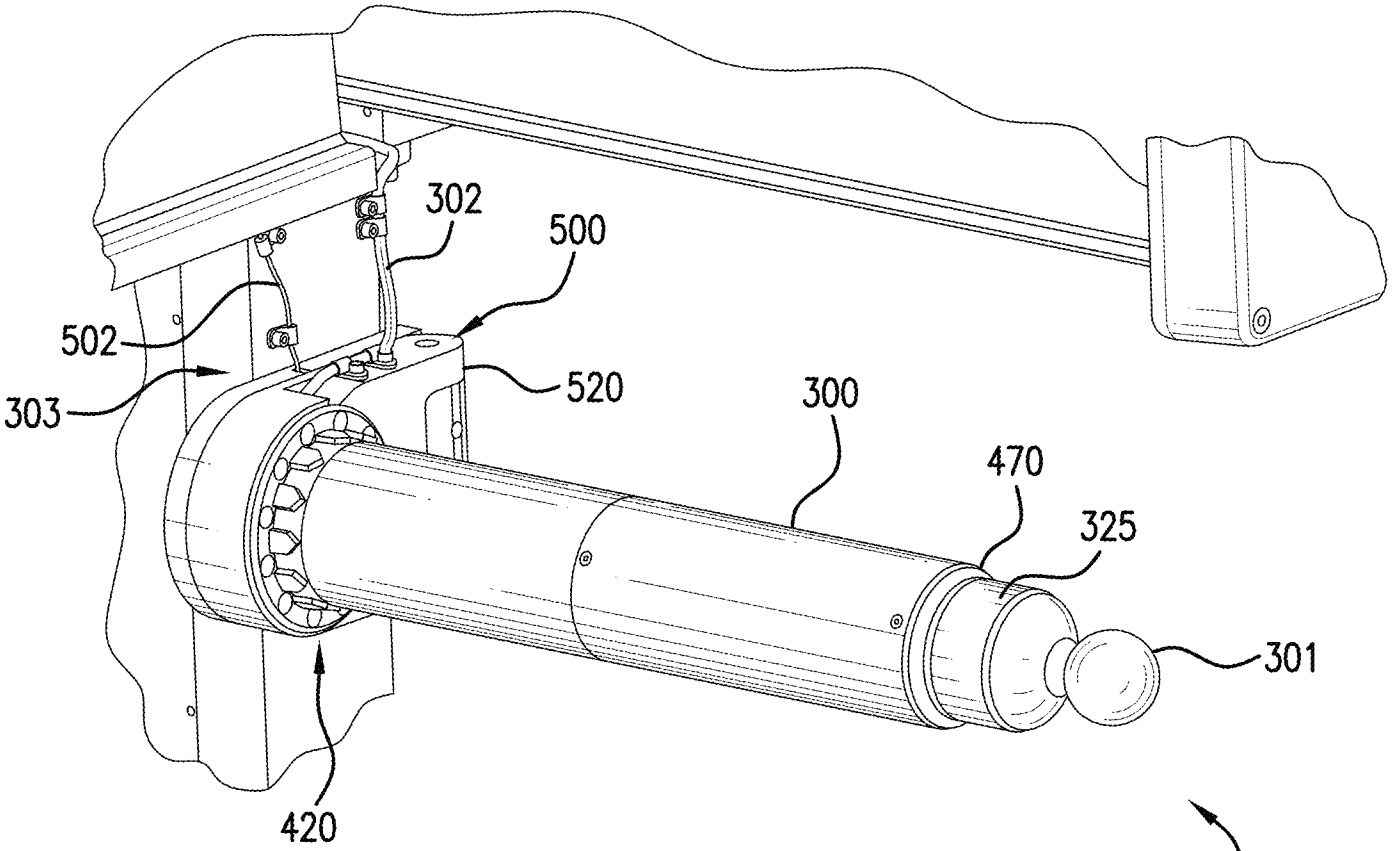
FIG. 12 shows an angled rear view of the film spindle.
Figure 13:
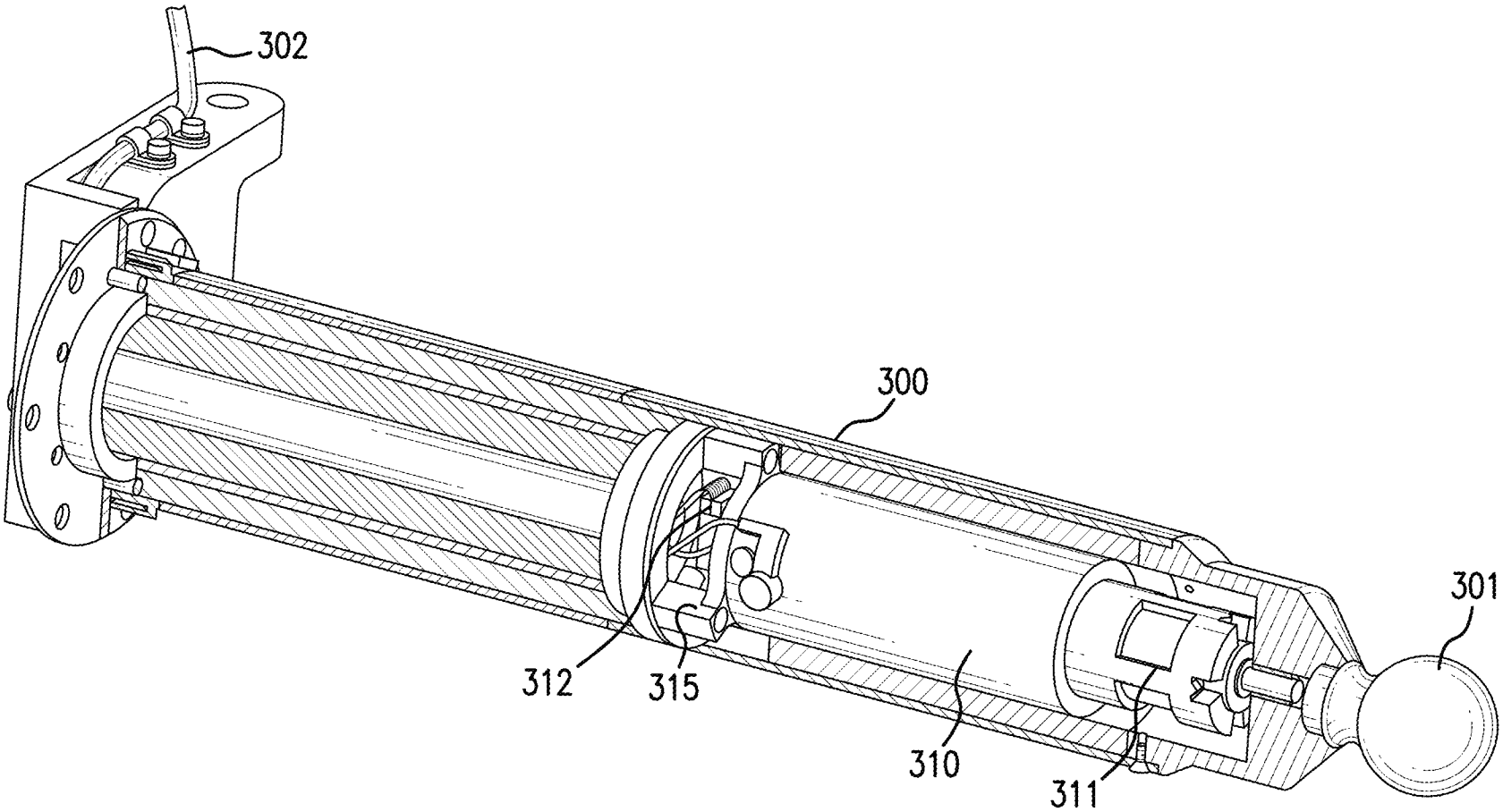
FIG. 13 shows a partial section assembly view of the film spindle.
Figure 14A:
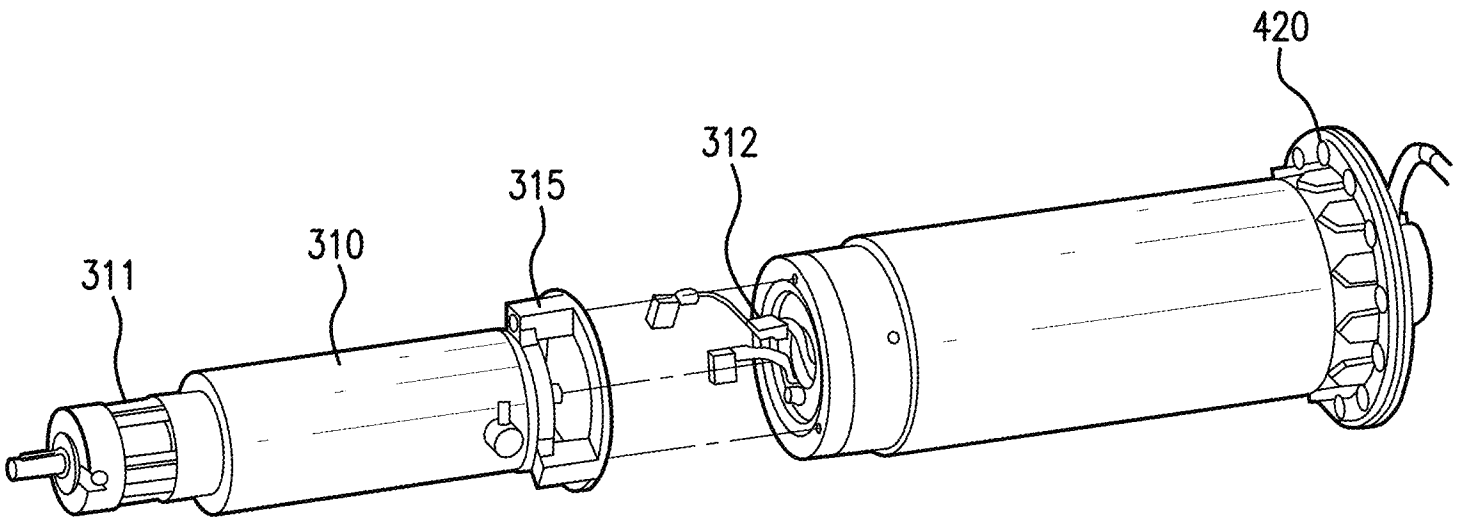
FIG. 14*a* shows a partially exploded view of the film spindle.
Figure 14B:
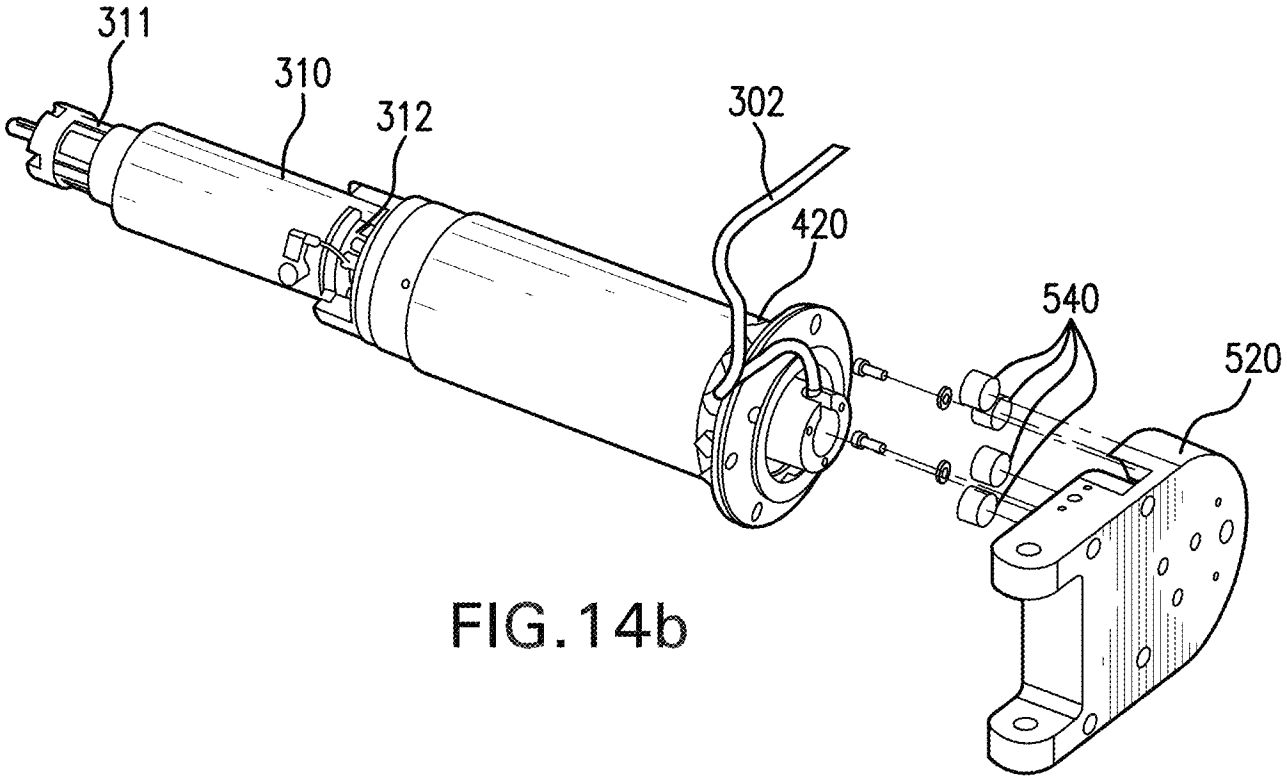
FIG. 14*b* shows a partially exploded view of the film spindle.
Figure 15A:
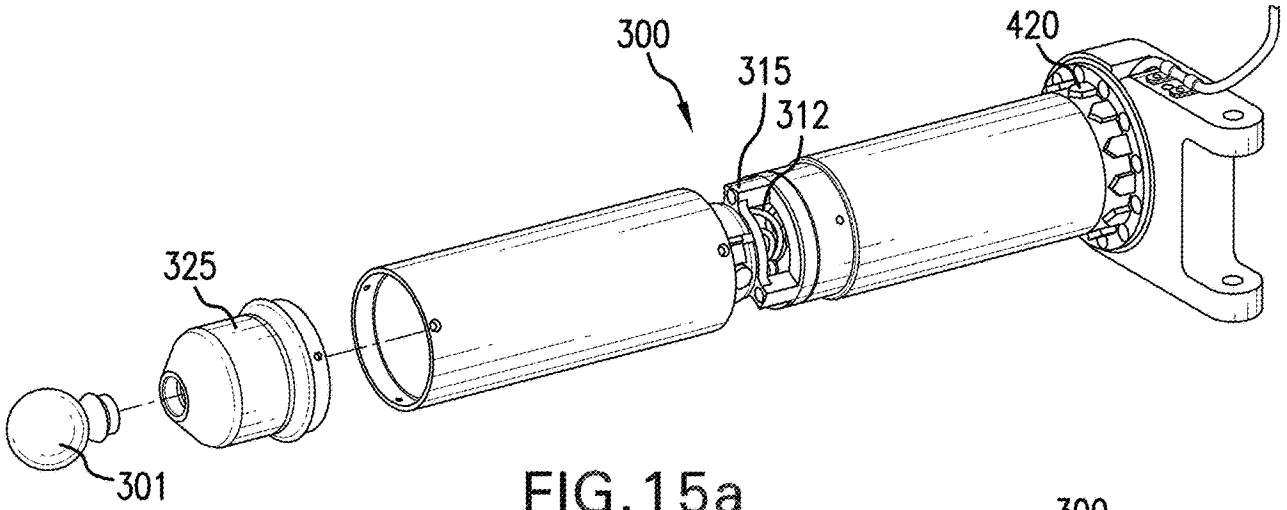
FIG. 15*a* shows a partially exploded view of the film spindle.
Figure 15B:
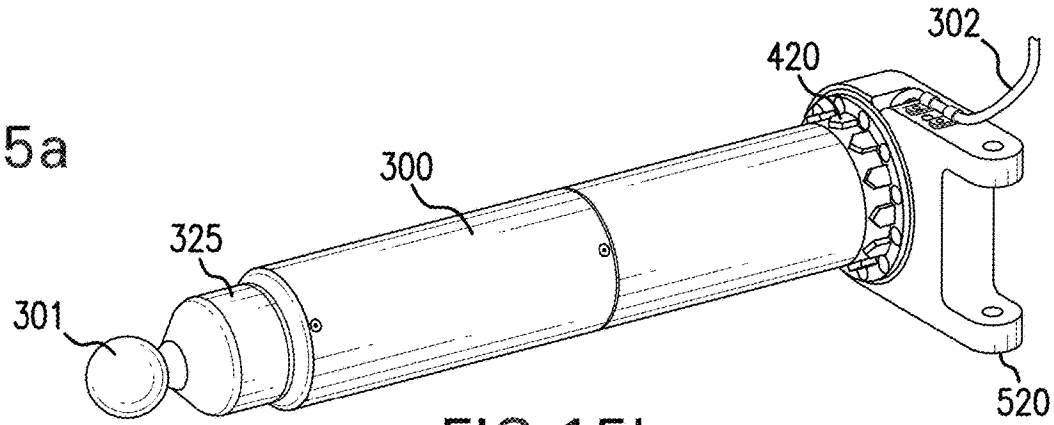
FIG. 15*b* shows an angled view of the film spindle.
Figure 15C:
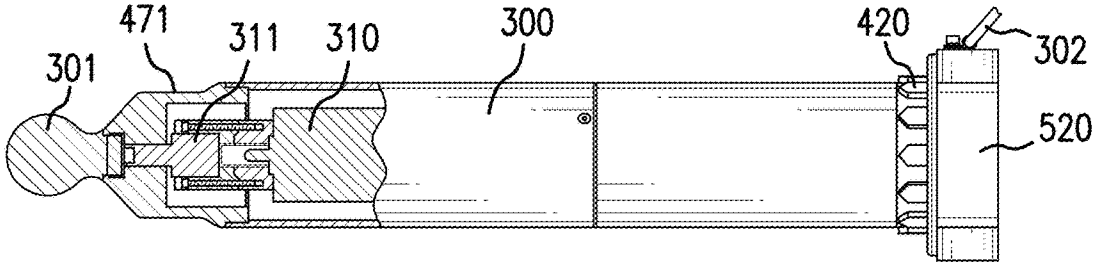
FIG. 15*c* shows a partial section assembly view of the film spindle.

Referring to FIG. 11, an inline pump assembly can be used that includes a pump 32*a* for the feed line of chemical A 28, and a pump 32*b* for the feed line of chemical B 30. As shown, inline pumps 32*a*, 32*b* can, in some embodiments, be housed within and mounted to a hose manager 49, which helps the telescoping column 48 to operate without interfering with the chemical lines 28, 30, and solvent line 6. The hose manager 49 can be mounted to the head of the device or to the upper telescoping portion to move with the head as it is raised or lowered, or alternatively can be mounted to the base of the device or another suitable location.

In operation, a film web 216 is fed to the apparatus 22. Cut/seal jaw 116 and complementary jaw 116*b* close to hold the film in place as cutting and sealing occurs. Venting holes are cut by vent cutter 162, and chemicals A and B are dispensed between the plies of the film. The jaw 116*b* is moved to opened, and the film 216 advances by operation of motor 80*a* and the nip rollers. The filled bag may be removed prior to or after opening of the jaw.

Some additional examples of these foam-in-bag fabrication devices can be seen in U.S. Pat. Nos. 5,376,219; 4,854,109; 4,938,007; 5,139,151; 5,575,435; 5,679,208; and 5,727,370. A further example of a foam-in-bag device is shown in U.S. Pat. No. 7,735,685, the contents of which are herein incorporated by reference in their entirety. Furthermore, an example of a vent cutting device is disclosed in U.S. Pat. No. 7,367,171, the contents of which are herein incorporated by reference in their entirety. The disclosure herein can, in the alternative, be used with any of the foam-in-bag systems discussed above. Furthermore, the present disclosure may be employed on any type of film handling machine (not only foam-in-bag devices, including, but not limited to, air filled pillow making devices, and other void-fill and protective packaging making devices. The disclosure may also be used in connection with other film converting machines or machines that draw a web off a roll, or machines that employ paper or other material rolls, such as those used in paper dunnage protective packaging.

Figure 26:
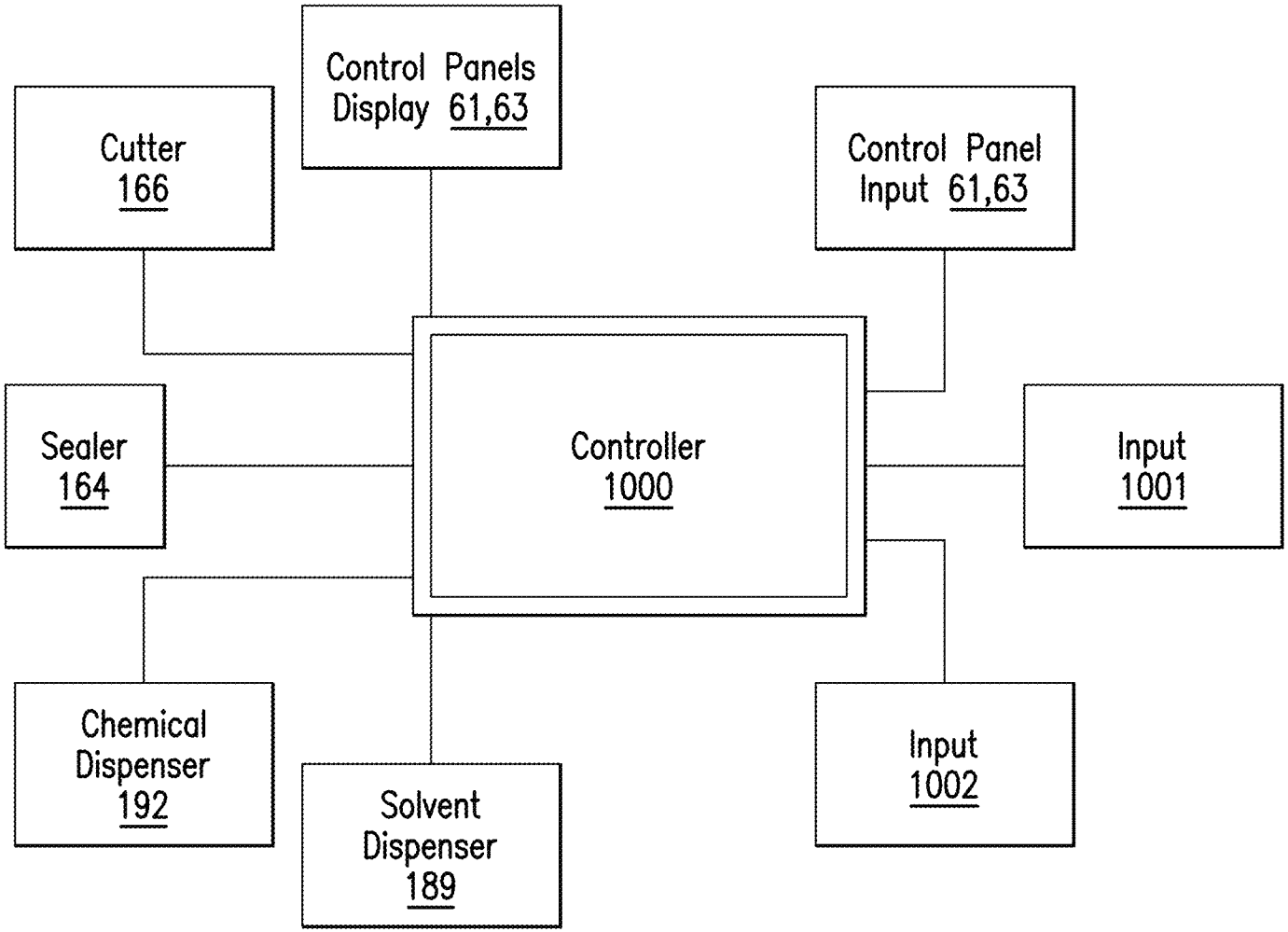
FIG. 26 illustrates a block diagram of a control system including a controller for use with the present disclosure.

With respect to any of the embodiments above, as shown in FIG. 26, a controller 1000 may be included and configured to control output to the display panels 61, 63, the cutter 166, the sealer 164, the chemical dispenser 192, or a solvent dispenser 189. Input to the controller 1000 may be from the control panels 61, 63, or from one or more inputs 1001, 1002, etc. as will be discussed in greater detail below. Controller 1000 may include, but is not limited to, a computer/processor that can include, e.g., one or more microprocessors, and use instructions stored on a computer-accessible medium (e.g., RAM, ROM, hard drive, or other storage device).

The controller 1000 may also include a computer-accessible medium (e.g., as described herein above, a storage device such as a hard disk, floppy disk, memory stick, CD-ROM, RAM, ROM, etc., or a collection thereof) can be provided (e.g., in communication with a processing arrangement). The computer-accessible medium can contain executable instructions thereon. In addition or alternatively, a storage arrangement can be provided separately from the computer-accessible medium, which can provide the instructions to the processing arrangement so as to configure the processing arrangement to execute certain exemplary procedures, processes and methods, as described herein above, for example.

Further, the exemplary processing arrangement can be provided with or include an input/output arrangement, which can include, e.g., a wired network, a wireless network, the internet, an intranet, a data collection probe, a sensor, etc. The exemplary processing arrangement can be in communication with an exemplary display arrangement 61, 63, which, according to certain exemplary embodiments of the present disclosure, can be a touch-screen configured for inputting information to the processing arrangement in addition to outputting information from the processing arrangement, for example. Further, the exemplary display 61, 63 and/or a storage arrangement can be used to display and/or store data in a user-accessible format and/or user-readable format.

With reference to FIGS. 12-26. A particular feature of the film roll reception assembly 56 is film web (216) tensioning. Providing web tension is beneficial in many applications in which film is withdrawn from a supply roll and converted or otherwise handled, such as in bag filling and making processes. In the embodiment disclosed, a lack of tension may produce slack in the film 216, making it difficult to accurately control web tracking through the system 22. If the film web 216 moves off track, the quality of the product produced by the system 22 may deteriorate. On the other hand, with too much tension, the web 216 can stretch and even break or tear. This may cause problems with any bag making process, and should be avoided where possible. Even variations in web tension between the two extremes (slack web to broken web) can lead to tracking problems. Assembly 56 can be configured to minimize changes in web tension throughout the bag making process.

In one embodiment, proper film web tension may be provided through use of one or more web tension motors. The web tension motor may provide torque in opposition to the direction of rotation of the film spindle (in an upstream direction), even though the motor may be driven by the film in the downstream direction of the film, so as to maintain and control the web 216 and to minimize or eliminate slack in the web 216. The web tension motor thus provides a force to oppose the pull on the web generated by the nip rolls 74,76, as the nip rolls 74,76 pull the film off of the roll on the film supply spindle 300 and through the bag-forming system 22. Alternative systems for tensioning the web 216 can be used, such as brakes or other systems to generate drag or otherwise pull against the web or the unwinding of the film supply roll 400.

In one embodiment, proper film web tension may be provided through use of one or more web tension motors. The web tension motor may provide torque in opposition to the direction of rotation of the film spindle (in an upstream direction), even though the motor may be driven by the film in the downstream direction of the film, so as to maintain and control the web 216 and to minimize or eliminate slack in the web 216. The web tension motor thus provides a force to oppose the pull on the web generated by the nip rolls 74,76, as the nip rolls 74,76 pull the film off of the roll on the film supply spindle 300 and through the bag-forming system 22. Alternative systems for tensioning the web 216 can be used, such as brakes or other systems to generate drag or otherwise pull against the web or the unwinding of the film supply roll 400.

Further provided on the assembly 56 in connection with the web tension motor 310 may be an encoder, which may be mounted to the motor shaft on the rear housing of the web tension motor 310. The encoder provides feedback on the rotational speed of the film spindle (for example, through inputs 1001,1002) to the machine's command and control system 1000. This feedback is used by the control system 1000 (see FIG. 26) and its algorithms to adjust the power to the tension motor as required to maintain web tension within the desired range in order to prevent the web from going slack, and to prevent damage to the web that would occur in the event of excessive tension. Alternative sensors or mechanisms of controlling the operation of the web tension motor can be used.

In one embodiment, the web tension motor 310, the encoder 312, and all associated spindle drive components may be positioned inside the film spindle, although external arrangements of these can alternatively be employed. As such, space on the inside of the spindle that would otherwise lie vacant is used, and the potential for interference with the operation of the system that may be caused by an exterior-located tension motor is avoided.

An internally located tension motor and encoder has been found to be particularly advantageous to the operation of the dispenser system 22. The tension motor 310 and preferably also the encoder 312 are disposed inside the spindle shaft can be partially or completely enclosed and protected and is thus not likely to get damaged during loading and unloading of the supply roll 400, or of pivoting of the spindle. This is accomplished by using a smaller motor than used on traditional foam-in-bag systems. The spindle can use a planetary gear box 311 to achieve the drive reduction needed for the smaller motor, which gearbox is itself compact enough to fit within the spindle. In some examples, the planetary gearbox can provide a 3:1, a 4:1, or a 5:1 drive reduction.

An internally located tension motor and encoder has been found to be particularly advantageous to the operation of the dispenser system 22. The tension motor 310 and preferably also the encoder 312 are disposed inside the spindle shaft can be partially or completely enclosed and protected and is thus not likely to get damaged during loading and unloading of the supply roll 400, or of pivoting of the spindle. This is accomplished by using a smaller motor than used on traditional foam-in-bag systems. The spindle can use a planetary gear box 311 to achieve the drive reduction needed for the smaller motor, which gearbox is itself compact enough to fit within the spindle. In some examples, the planetary gearbox can provide a 3:1, a 4:1, or a 5:1 drive reduction.

The encoder can be a magnetic encoder 312 or another suitable type of encoder or other type of sensor for controlling the motor, although a magnetic encoder is preferred due to its substantially lower cost, smaller size, and increased reliability than most other types. The encoder 312, positioned as described, provides electrical pulses to the control system as the shaft turns. An internally located encoder allows for the use of a magnetic encoder, which would not be possible (due to the risk of damage) if it were located outside of the spindle. An internally located tensioning mechanism also preferably eliminates the possibility of interference with any hoses and cables that may run down the back side of the support assembly 48. These can include the A side chemical line 30, the B side chemical line 28, the main power cable, the A side pump cable, and the B side pump cable. Alternatively, the encoder could be mounted externally. Further, alternative methods of controlling the tension motor can be employed, including known electrical or physical methods.

Figure 16A:
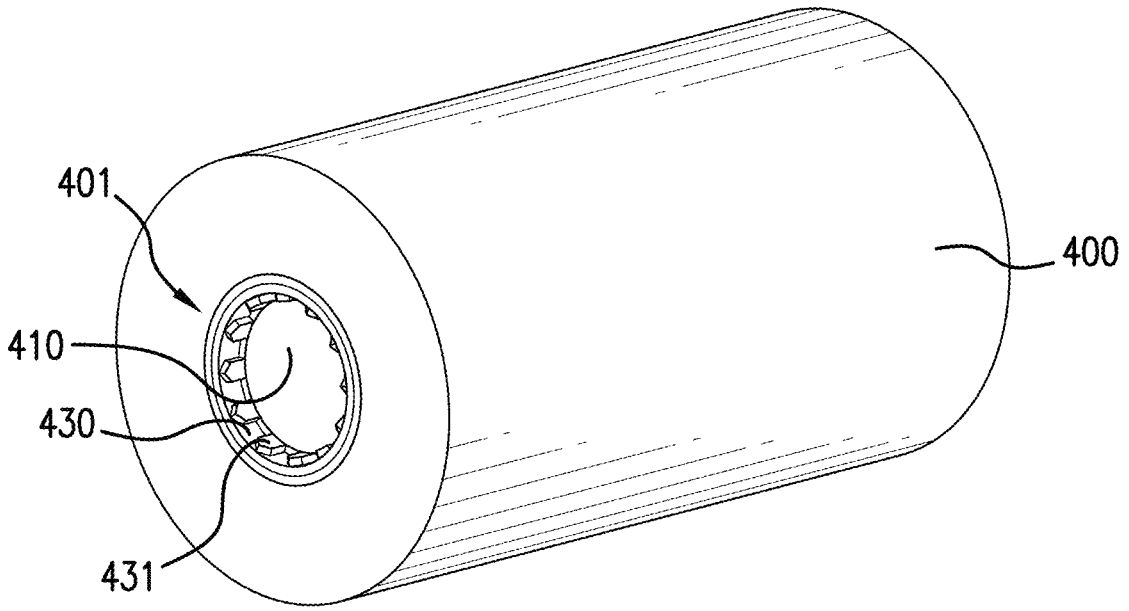
FIG. 16*a* shows a film roll in accordance with for use on the dispenser apparatus.
Figure 16B:
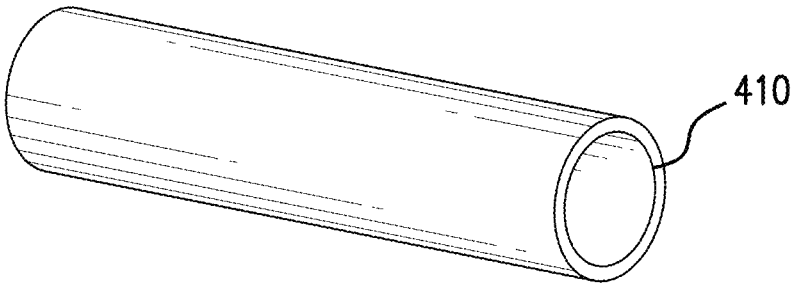
FIG. 16*b* shows a core of the film roll of FIG. 16*a;*

Referring to FIGS. 16*a* and 16*b*, a film web 216 is provided wrapped around the core 410, which in some embodiments may be a heavy duty paper or plastic core. The width of the film roll, in one embodiment, is between 15 inches and 25 inches, and preferably about 19 inches. The full roll diameter, in one embodiment, is between about 8 and 12 inches, and in one embodiment is about 10.5 inches. Depending on the type of wind (centerfold or gusseted) a roll of bagger film 400 will typically contain two to three thousand feet of film web 216, and weigh between 30 and 50 pounds.

The film roll 400 and the spindle 300 have a coupling device 401 the couples the roll 400 to the driven portion of the spindle 300 and the tension motor 310. Preferably, the coupling device 401 is configured for associating the core 410 of the roll 400 with the motor 310 to enable the motor 310 to transfer torque to the roll 400. The coupling device 401 preferably is also configured for retaining the roll 400 in the coupled association with the spindle 300 and motor 310, and more preferably is configured for automatically placing the roll 400 and spindle 300 in the coupled association upon loading of the roll 400 on the spindle 300.

The spindle coupling portion 401 of the coupling device 401 in the preferred embodiment is configured to engage the roll coupling portion 401 when the roll 400 is loaded onto the spindle 300. The core plug 430 shown is preferably the drive side core plug configured for inserting first onto the spindle 300 when the roll 400 is loaded. The core plug 430 preferably has inwardly extending teeth 431, or another engagement feature, around its inner diameter that are configured to mate with the spindle coupling portion 401. In the preferred embodiment, the spindle coupling portion 401 is configured as a drive spline member 420, and the teeth 431 of the core coupling portion 401 are configured to engage corresponding teeth 421 or other suitable features on the outer diameter of the drive spline member 420, which is also preferably disposed at the base of the film spindle 300. Alternative coupling devices can be used to fix or couple the spindle 300 against relative rotation with respect to the core, although other arrangements can be envisioned in which some degree of slippage is permitted therebetween while still being able to transfer torque from the spindle to the roll. Preferably, the film roll 400 is coupled to rotate in sync with the spindle 300. Alternative coupling methods can be employed, including, for example, spring loaded catches that can be disengaged by pulling the core 410 off the spindle 300. The splines have the tapered tips, tapered in a longitudinal axis with respect to the direction of the spindle 300, that auto align the spline 420 and the core plug 430 into engagement with one other.

The spindle coupling portion 401 of the coupling device 401 in the preferred embodiment is configured to engage the roll coupling portion 401 when the roll 400 is loaded onto the spindle 300. The core plug 430 shown is preferably the drive side core plug configured for inserting first onto the spindle 300 when the roll 400 is loaded. The core plug 430 preferably has inwardly extending teeth 431, or another engagement feature, around its inner diameter that are configured to mate with the spindle coupling portion 401. In the preferred embodiment, the spindle coupling portion 401 is configured as a drive spline member 420, and the teeth 431 of the core coupling portion 401 are configured to engage corresponding teeth 421 or other suitable features on the outer diameter of the drive spline member 420, which is also preferably disposed at the base of the film spindle 300. Alternative coupling devices can be used to fix or couple the spindle 300 against relative rotation with respect to the core, although other arrangements can be envisioned in which some degree of slippage is permitted therebetween while still being able to transfer torque from the spindle to the roll. Preferably, the film roll 400 is coupled to rotate in sync with the spindle 300. Alternative coupling methods can be employed, including, for example, spring loaded catches that can be disengaged by pulling the core 410 off the spindle 300. The splines have the tapered tips, tapered in a longitudinal axis with respect to the direction of the spindle 300, that auto align the spline 420 and the core plug 430 into engagement with one other.

In one embodiment, there may be 3, 4, 5, 6 or more directional barbs 433 molded into the outer diameter of the core plug 430. These barbs are directional in the sense that they allow the core plug 430 to slide into the paper core 410 with relative ease, but make it difficult for the core plug 430 to be pulled out. The barbs 433 (along with some optional smaller, parallel splines 432) also prevent the core plug 430 from rotating inside of the paper core 410. This is relevant to the proper functioning of the bag making system, as it syncs the film roll 400 to the film spindle 300.

Figure 17B:
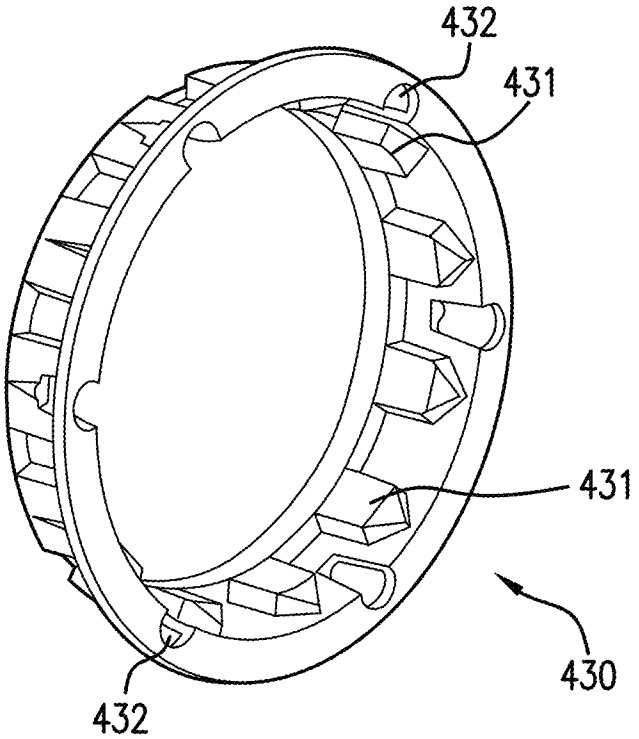
FIGS. 17*a* and 17*b* show a drive side core plug for use with the film roll.
Figure 17A:
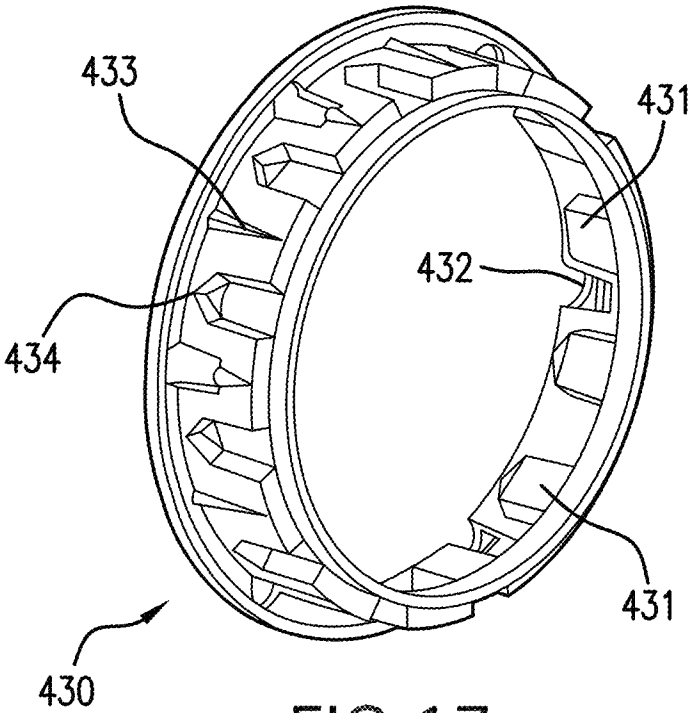
Figure 17C:
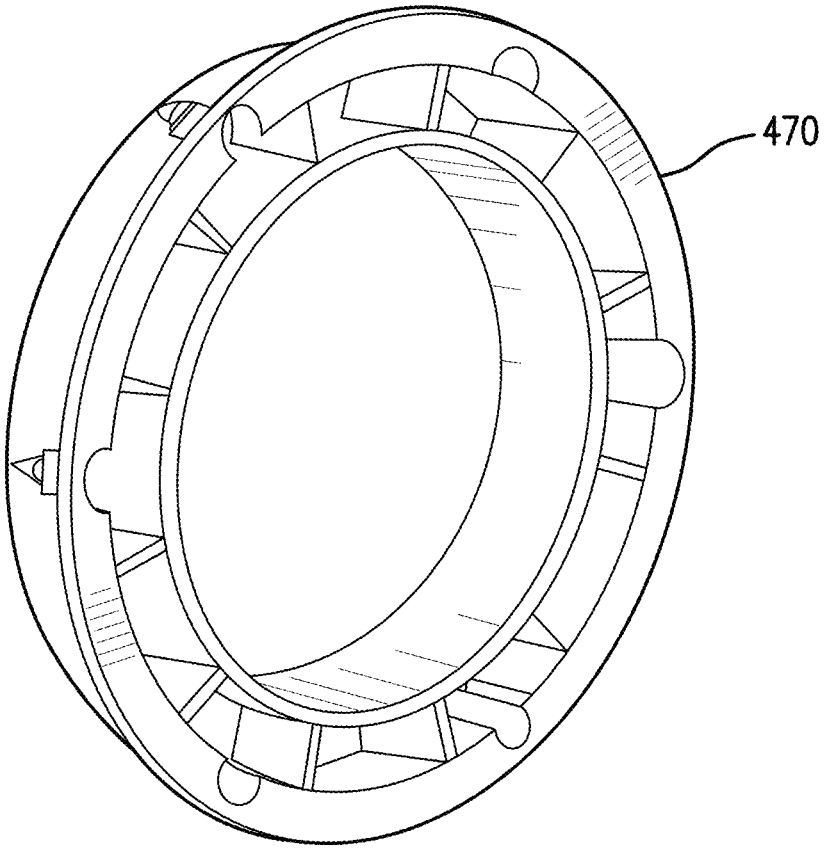
FIG. 17*c* shows a support side core plug for use with the film roll.

A further, support side core plug 470 may be provided in some embodiments, as shown in FIG. 17*c*. This support side core 470 plug may be installed into the inner diameter of the paper core 410 on the end opposite the drive side core plug 430. Similar to the drive side core plug 430, the support side core plug may include barbs on its outer diameter or another mechanism to affix it to or retain it with the core. The support side core plug has a smaller diameter than the drive side core plug 430, thus preventing backwards installation of the roll 400 on the spindle 300. The smaller diameter at the support side end of the spindle, as shown best in FIG. 15*c* at 471, results in a "stepped" configuration of spindle 300 in a preferred embodiment.

In some embodiments, the drive side core plug 430, the support side core plug 470, and the core 410 are separate components that are assembled to form the web support structure of the present disclosure. In preferred embodiments, the drive side core plug 430, the support side core plug 470, and the core 410 form an integral and unitary web support structure.

The spindle 300 and roll 400 may include one or more members that auto-engage the roll on the spindle. In some embodiments, magnets are used on one or both of the base 520 of the spindle 300 (or spline member 420) and the core 410 or the core plug 430. In preferred embodiments, a plurality of small magnets 440, which can be neodymium-iron-boron magnets, for example, are installed at the base of the film spindle 300, preferably in close proximity to where the flat, end face of the drive side core plug 430 engages with the face of the drive spline 420. These magnets 440 can be positioned to contact or to end up in close proximity with the end face (FIG. 17*a*) of the drive side core plug 430 when it's fully engaged with the drive spline 420 at the base of the spindle 300.

Correspondingly, the drive side core plug 430 or the core preferably includes a material that is magnetically attracted to the magnets 440. In one embodiment, the drive side core plug 430 includes a ferrous material, and can be made of steel, include piece or pieces of a ferrous material, such as stamped sheet steel, or preferably be injection molded from a steel-filled plastic, for example Nylon. Additional magnets could alternatively be used. The steel filler may be provided in the plastic in a powder form so as to blend into the molded polymer matrix. The steel powder in the core plug 430 provides a degree of attraction for the magnets 440, and the magnets 440 are thus able to secure the core plug 430 to the drive spline 420 with force sufficient for normal machine operation, but low enough to allow the core 410 to be pulled off the spindle by hand when the core is empty or if the roll 400 is desired to be changed. The holding force can be adjusted by design through increasing or decreasing the percentage or amount of steel fill in the molded plastic core plug 430, changing the size or configuration of the magnets, changing the magnet material, or changing the number of magnets used. In some embodiments, magnets are provided in both the core 410 and spindle base 520, and in others, one or more magnets are provided in the core, with a ferrous material provided in the base 520. Other types of magnets can be employed, including other types of permanent magnets, or inductors or other electronic magnets.

Figure 18:
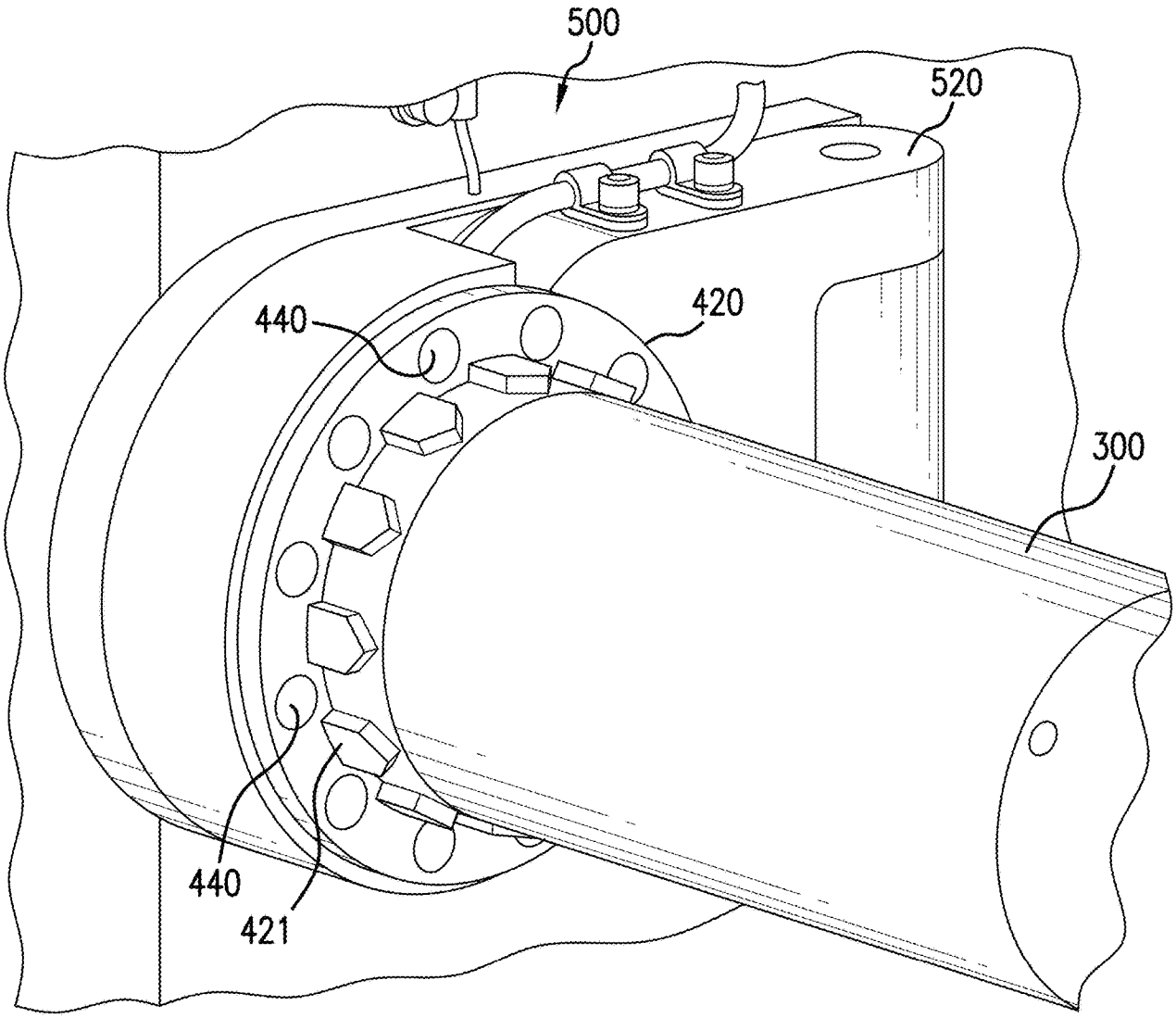
FIG. 18 shows a view of the drive spline of the spindle.

FIG. 18 shows a closer view of the base of the film spindle 300, where nine of the twelve magnets 440 mounted within the drive spline 420 are visible. These magnets 440 are mounted such that they stand slightly proud of the face of the drive spline 420, so the steel filled core plug 430 will come into direct contact with at least some of the magnets 440 when the roll 400 is mounted on the spindle 300. This "zero-gap" design maximizes the force available from the magnets, as magnetic attraction is decreased by the square of the spacing so that even small gaps cause a substantial reduction in holding force. Minimizing these gaps allows the design to achieve a given holding force at lower cost, either in terms of lower cost or smaller magnets, the use of fewer magnets, or by reducing the percentage of steel filler in the molded core plug. As such, the film roll 400 can be secured to the spindle 300 without using any moving parts.

Figure 19:
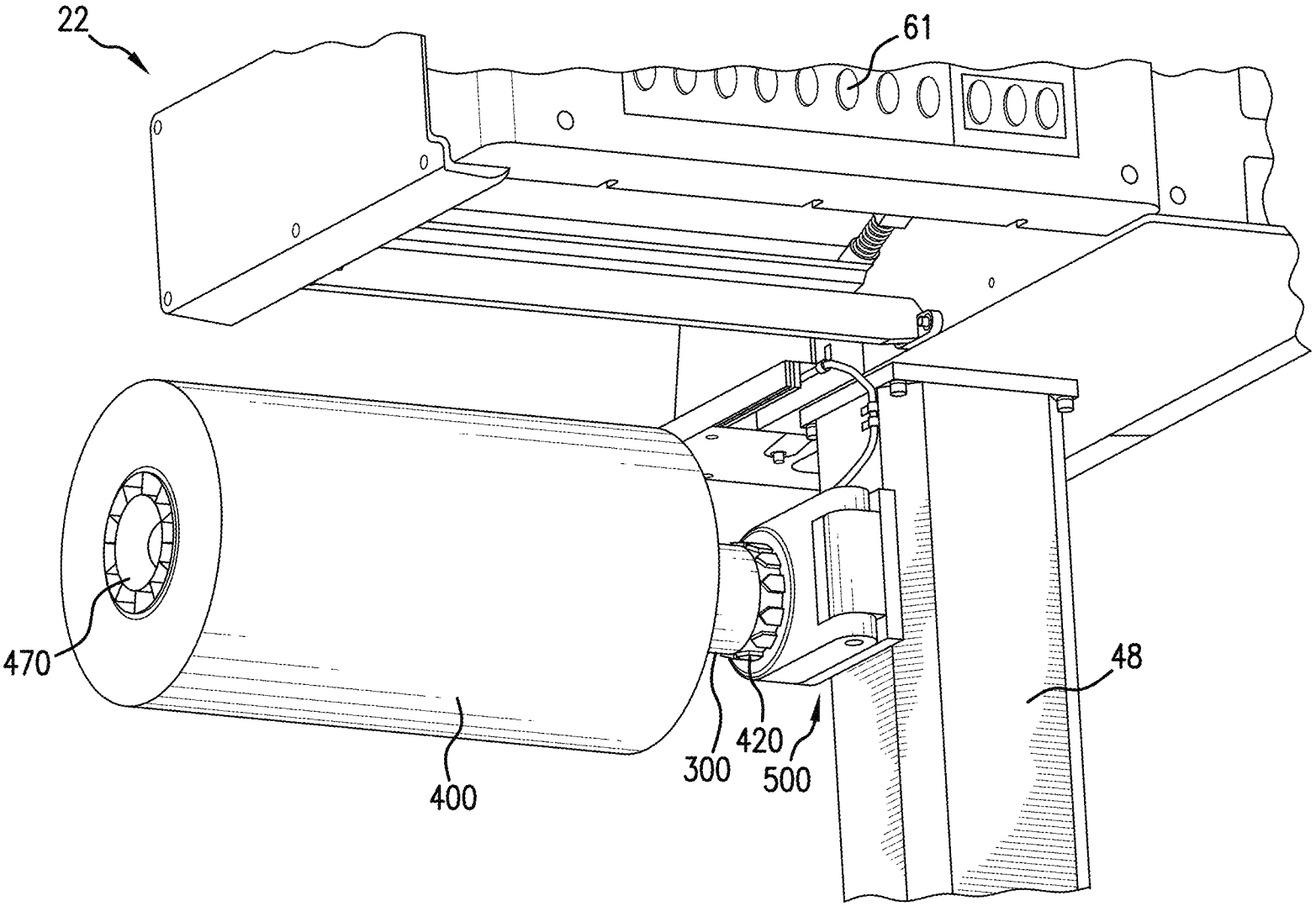
FIG. 19 shows a film roll partially mounted onto the film spindle.

FIG. 19 shows the film roll 400 as it slides onto the spindle 300. The drive spline 420 and some of the magnets 440 are visible as the roll 400 has yet to engage with the base of the spindle 300. Once the roll 400 is fully slid on to the spindle 300, the magnets 440 in the base of the spindle hold the film roll 400 securely to the drive spline 420. The drive spline 420 engages with the matching teeth 431 in the drive side core plug 430 to sync the roll to the spindle. The web tension motor, located inside the spindle, can then drive the film roll 400 and control the tension in the film web through the apparatus.

Figure 20:
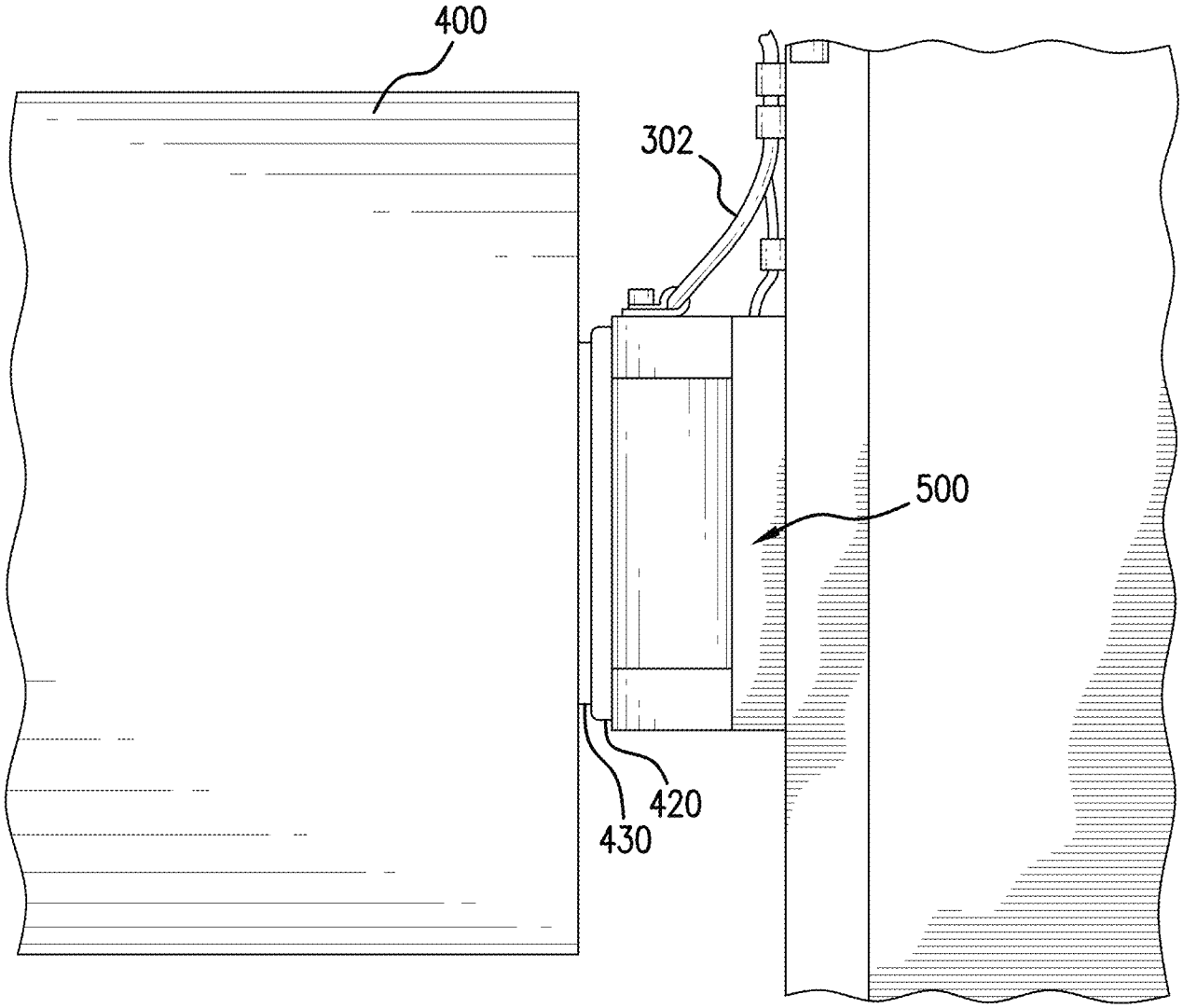
FIG. 20 shows the proximity of the film roll to the spindle base when fully inserted onto the spindle.

FIG. 20 shows the film roll 400 fully engaged with the drive spline 420 at the base of the spindle 300. There is no gap between the drive side core 430 plug and the spline 420. The magnets 40 in the base pull the core plug in the roll into flush contact with the face of the drive spline 420.

Figure 21B:
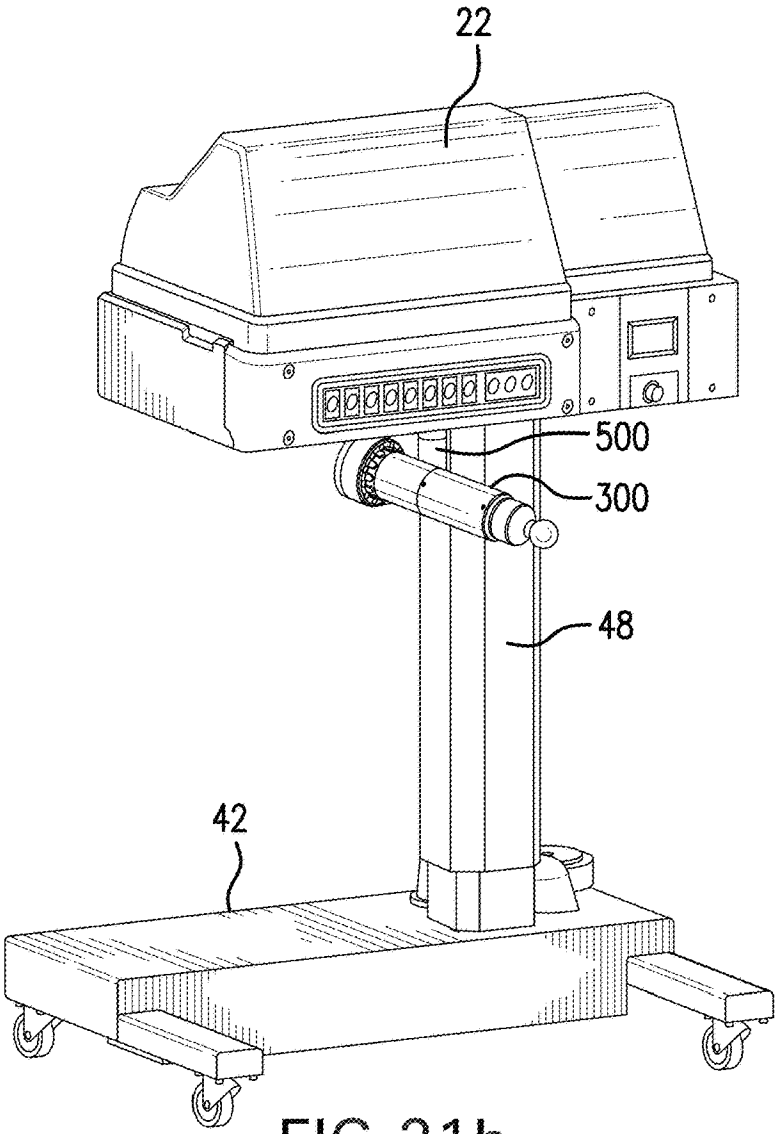
FIGS. 21*a* and 21*b* show the film spindle in an operational position and an open position, respectively.
Figure 21A:
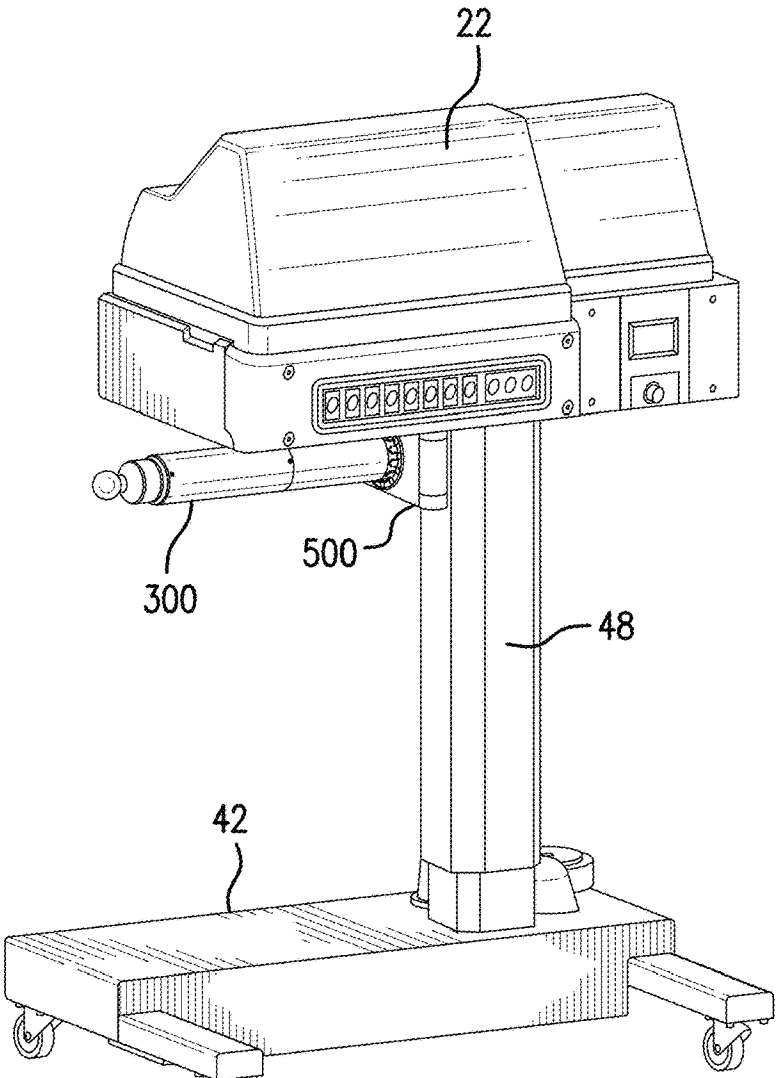

In one embodiment, magnetic force is further used as a means for which to retain or latch a hinged film unwind spindle 300 onto the base of a dispenser apparatus 22. As shown in FIGS. 21*a*, 21*b*, and also FIG. 12, film spindle 300 is mounted to the support column 48 of the apparatus, in order to support the film roll 400 in its proper orientation with respect to the apparatus.

The film spindle 300 is hinged to enable rotation about a vertical axis near its base, where it is attached to a machine support column. In one embodiment, film spindle base and hinge assembly 500 will enable rotation of about 150-210°, or preferably about up to about 180°. The film spindle 300 includes a magnetic latching means to secure the spindle in its home or operating position (FIGS. 21*a* and 12), where it must be situated during machine operation.

Figure 22:
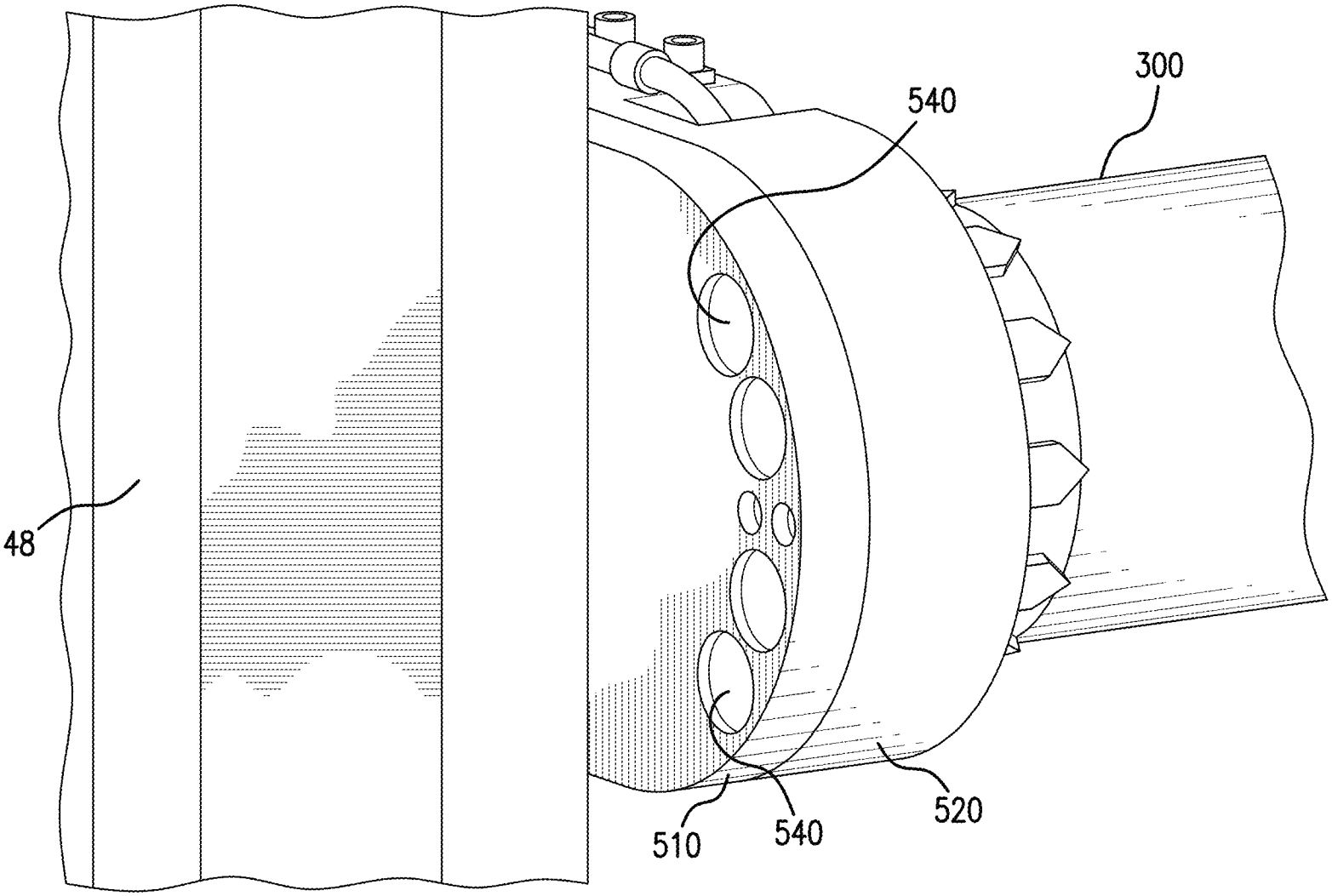
FIG. 22 shows a view of the spindle base, the hinge base, and the steel plugs located therein.

Referring now to FIG. 22, a one, two, or more magnets, which in a preferred embodiment may be a set of four Neodymium (NdFeB) magnets, located in the base of the spindle 300 match a set of four steel plugs 550 in the hinge base 510, to provide a magnetic based holding or latching force that maintains the film spindle 300 in its home position during machine operation. The four round holes, visible on the back of the hinge base 510 are the locations of the steel plugs 550 that are pulled on by matching magnets inside the spindle 300. The steel plugs are secured into their respective holes in the back of the hinge base with an adhesive, for example an epoxy. The hinge base 510 is secured to the column 48 with, for example, machine screws or other connectors. As such, this latching mechanism uses no moving parts, eliminating the need for an operator to manually release a mechanical latch near the base of the film spindle in order to unlatch the spindle, as is found on some prior art devices. The operator can pivot the film spindle towards the front of the machine by merely pulling on the end of the spindle with sufficient force to exceed the hold of the magnets. The magnet latch, however, is provided with enough holding force so it does not come unlatched during normal machine operation and operator use. Other types of magnets can be employed, including other types of permanent magnets, or inductors or other electronic magnets.

The film spindle design disclosed herein, in one embodiment, incorporates a sensor that can detect the spindle in the home position. In one embodiment, a Hall Effect sensor is located in the spindle hinge base 510 which is securely attached to the machine support column 48 and does not rotate with the spindle base 520. The Hall sensor detects the presence of a small magnet embedded into the spindle base 520 when the spindle 300 is in its home position. The Hall sensor in the hinge base 510, in conjunction with the small magnet in the spindle base 520, allows the control system a means to determine if and when the film spindle is in its home position. As such, the Hall Effect sensor can provide a signal to prevent the machine from operating if the film spindle 300 is not in its home position. The control system can be configured so as to go into a shutdown mode and prevent the machine from operating if the film spindle is out of its home position. In conjunction there with, the control system may display, for example on display 63, an alert to the operator, with a shutdown message, that the film spindle 300 is out of position.

Figure 23:
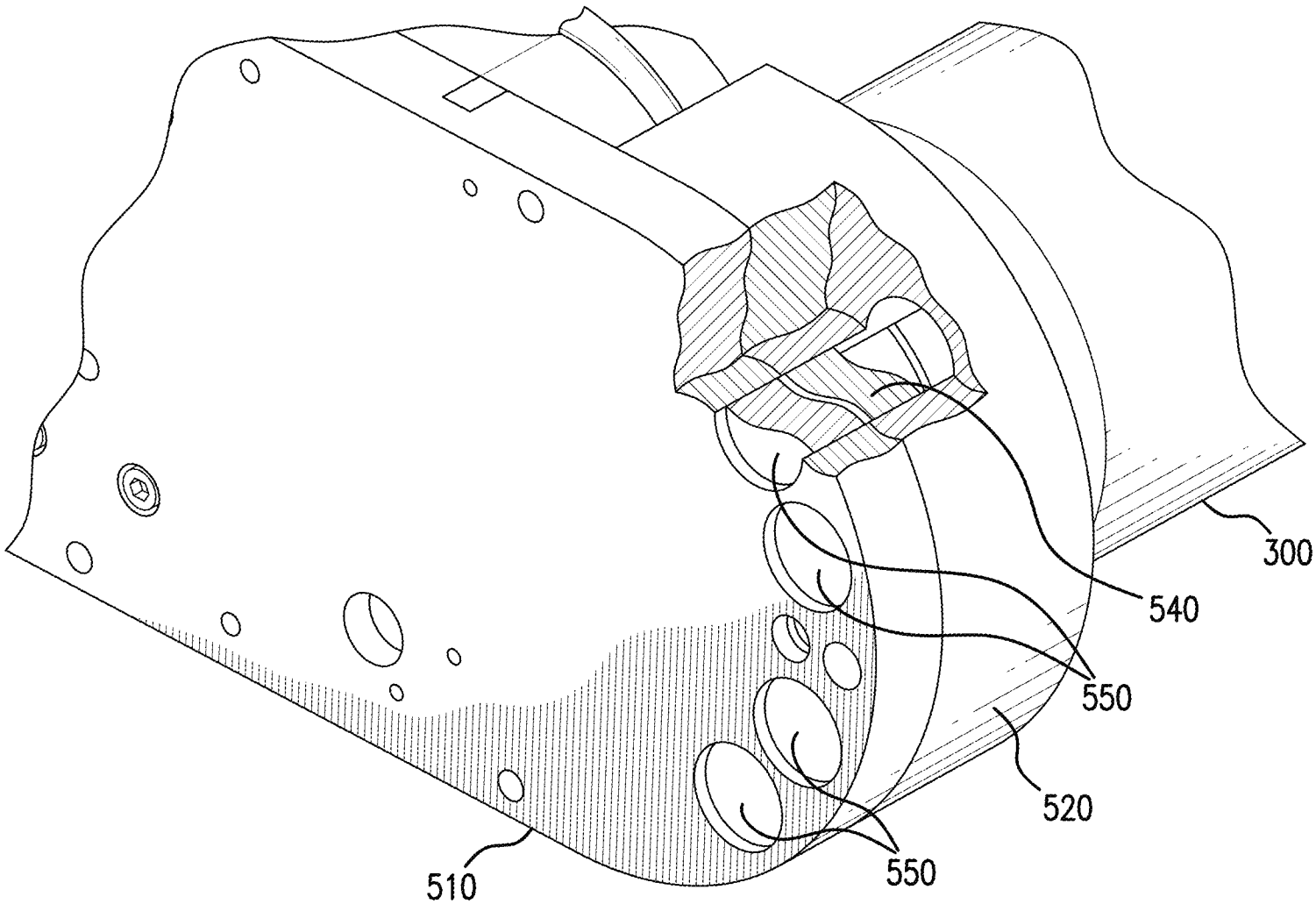
FIG. 23 shows a cutaway view of the spindle base, the steel plugs located therein, the hinge base, and the magnets located therein.

FIG. 23 shows a cutaway wherein the positioning of the magnets 540 in the spindle base 520 are shown, in relation to the steel plugs 550 in the hinge base 510. They are located sufficiently proximate to one another so as to provide the desired attractive force. In other words, the spacing between the magnets 540 and the steel plugs 550 has been minimized to maximize the holding force. In some embodiments, both the spindle base 520 and the hinge base 510 may be machined from aluminum, which has a minimal attenuation on magnetic flux fields. Alternatively, the magnets and the ferrous material can be reversed in position, or magnets can be used on both sides 510, 520.

Figure 24A:
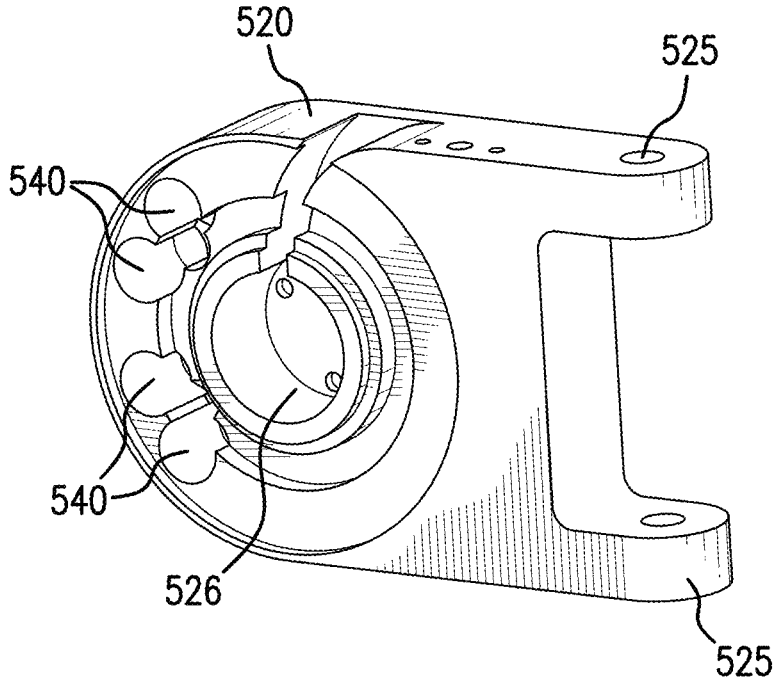
FIGS. 24*a* and 24*b* show a schematic view of the spindle base.
Figure 24B:
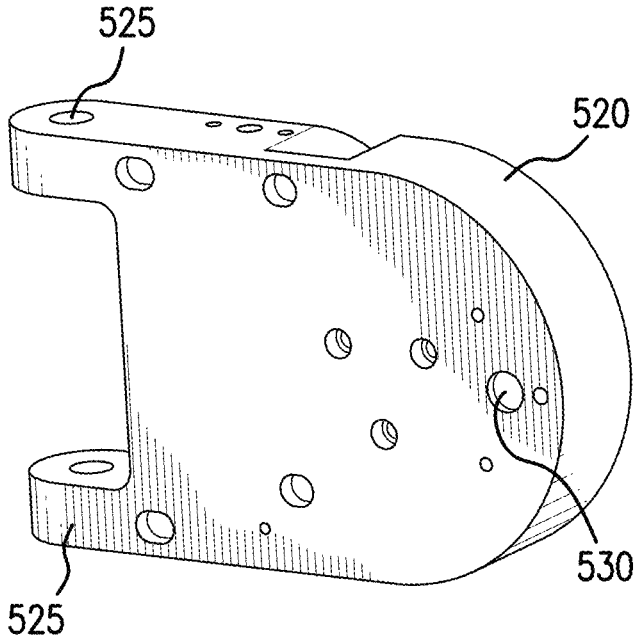

FIGS. 24*a* and 24*b* show a schematic representation of the spindle base 520, including the four magnets 540, and a hinge portion 525 for connection with the hinge base 510. FIG. 24*a* shows the spindle facing side thereof (with spindle reception portion 526 shown), and FIG. 24*b* shows the column facing side, which includes a small magnet 530 for detection by the Hall Effect sensor. The small magnet shown as item 530 is embedded into the spindle base 520 where it can be sensed by the Hall Effect Sensor in the hinge base 510, and used to determine if the film spindle 300 is in its home position or not. As this magnet is only used as part of a proximity sensing system, it can be much smaller than the magnets used to secure the spindle in its home position. Reference is also made again here to FIG. 14*b*, where an exploded view of the spindle 300, its base 520, and the magnets 540 are shown.

Figure 25A:
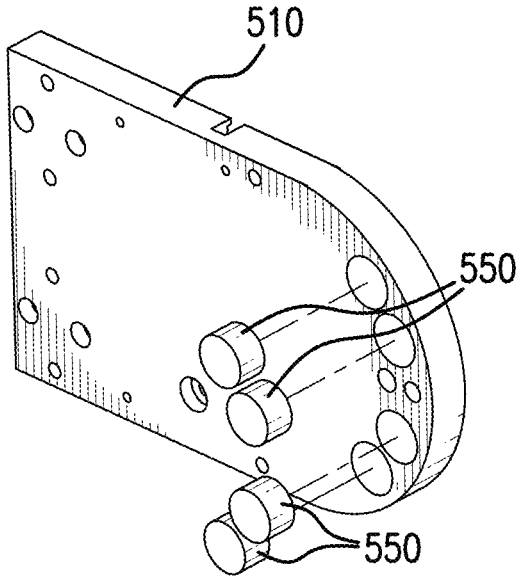
FIGS. 25*a* and 25*b* show a schematic view of the hinge base.
Figure 25B:
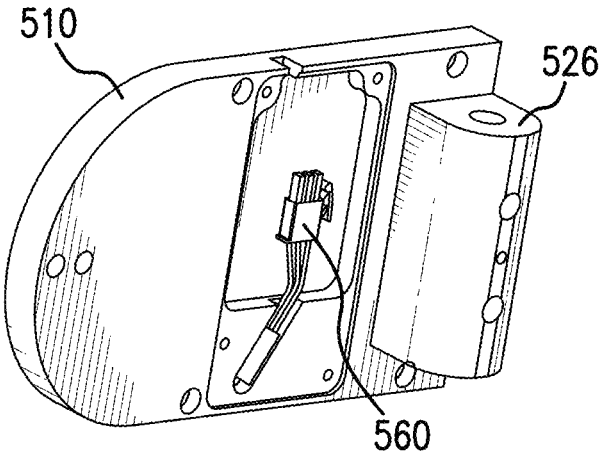

FIGS. 25*a* and 25*b* show a schematic representation of the hinge base 510, including the four steel plugs 550, and a hinge portion 526 for connection with the spindle base 520. FIG. 25*a* shows the column facing side thereof, and FIG. 25*b* shows the spindle facing side thereof, including the positioning of the Hall Effect sensor 560. Any suitable Hall Effect sensor can be used with the present disclosure, however it has been found that the Honeywell Hall Effect Sensor SR13C-A1 is preferable.

The terms "substantially" or "generally" as used herein to refer to a shape is intended to include variations from the true shape that do not affect the overall function of the device. The term "about," as used herein, should generally be understood to refer to both numbers in a range of numerals. Moreover, all numerical ranges herein should be understood to include each whole integer within the range. The terms "front," "back," "upper," "lower," "side" and/or other terms indicative of direction are used herein for convenience and to depict relational positions and/or directions between the parts of the embodiments. It will be appreciated that certain embodiments, or portions thereof, can also be oriented in other positions.

While illustrative embodiments are disclosed herein, it will be appreciated that numerous modifications and other embodiments can be devised by those of ordinary skill in the art. Features of the embodiments described herein can be combined, separated, interchanged, and/or rearranged to generate other embodiments. Therefore, it will be understood that the appended claims are intended to cover all such modifications and embodiments that come within the spirit and scope of the present disclosure.

What is claimed is:

1. A protective packaging device, comprising:

a filling mechanism configured for filling a space between plies of a web with a substance;

a sealing mechanism configured for sealing the filled plies to retain the substance therebetween; and a supply unit comprising:

a roll core and the web provided as a roll thereon, which roll core comprises:

a roll core mechanical coupling portion comprising a plurality of roll core engagement features spaced around an inner diameter thereof; and a roll core magnetic coupling portion; and a web handling system comprising:

a base portion; and a spindle extending from the base portion and configured for receiving the roll core thereon, the spindle being further configured to rotate about a horizontally-oriented axis extending in an axial direction of the spindle, the spindle comprising:

a first end portion adjacent the base portion;

a freestanding second end portion;

a spindle mechanical coupling portion located at the first end portion of the spindle and comprising a plurality of spindle engagement features spaced around the spindle mechanical coupling portion and extending in the axial direction of the spindle between a first and a second axial position, wherein the spindle engagement features of the spindle mechanical coupling portion and the roll core engagement features of the roll core mechanical coupling portion mate with each other to transmit torque between the spindle and the roll core; and a spindle magnetic coupling portion located at the first end portion of the spindle and on the spindle mechanical coupling portion, the spindle magnetic coupling portion comprising at least one magnet positioned, at least in part, at the first axial position and radially outward of the spindle engagement features, the spindle magnetic coupling portion being configured to magnetically attract the roll core magnetic coupling portion in a horizontal direction to maintain the mating of the spindle engagement features of the spindle mechanical coupling portion and the roll core engagement features of the roll core mechanical coupling portion when the roll core is received on the spindle.

2. The protective packaging device of claim 1, wherein the substance comprises a foam precursor that is adapted to solidify into protective foam packaging.

3. The protective packaging device of claim 1, wherein the spindle mechanical coupling portion is configured for insertion into the roll core mechanical coupling portion to engage the spindle mechanical coupling portion and the roll core mechanical coupling portion.

4. The protective packaging device of claim 1, wherein the roll core magnetic coupling portion comprises a material that is magnetically attracted to magnets.

5. The protective packaging device of claim 4, wherein the roll core magnetic coupling portion comprises a ferrous material impregnated in a plastic matrix.

6. The protective packaging device of claim 5, wherein the roll core mechanical coupling portion comprises the ferrous material impregnated in the plastic matrix, such that the roll core mechanical coupling portion and the roll core magnetic coupling portion include a same portion of the roll core.

7. The protective packaging device of claim 1, wherein the at least one magnet comprises a neodymium-iron boron magnet.

8. The protective packaging device of claim 1, wherein the at least one magnet comprises a permanent magnet.

9. The protective packaging device of claim 1, wherein the at least one magnet comprises an electronic magnet.

10. The protective packaging device of claim 9, wherein the electronic magnet comprises an inductor.

11. The protective packaging device of claim 1, wherein the spindle engagement features comprise teeth or splines.

* * * * *